US008879749B2

(12) United States Patent
Terada et al.

(10) Patent No.: US 8,879,749 B2
(45) Date of Patent: Nov. 4, 2014

(54) DIRECTIONAL MICROPHONE DEVICE AND DIRECTIVITY CONTROL METHOD

(75) Inventors: Yasuhiro Terada, Kanagawa (JP); Takeo Kanamori, Osaka (JP)

(73) Assignee: Panasonic Corporation, Osaka (JP)

( * ) Notice: Subject to any disclaimer, the term of this patent is extended or adjusted under 35 U.S.C. 154(b) by 387 days.

(21) Appl. No.: 13/390,373

(22) PCT Filed: Jun. 16, 2011

(86) PCT No.: PCT/JP2011/003427

§ 371 (c)(1),
(2), (4) Date: Feb. 14, 2012

(87) PCT Pub. No.: WO2012/001898

PCT Pub. Date: Jan. 5, 2012

(65) Prior Publication Data

US 2012/0140948 A1 Jun. 7, 2012

(30) Foreign Application Priority Data

Jul. 2, 2010 (JP) ..... 2010-152030

(51) Int. Cl.

| | |
|---|---|
| ***H04R 3/00*** | (2006.01) |
| ***H04R 29/00*** | (2006.01) |
| *H04R 1/40* | (2006.01) |
| *H04R 25/00* | (2006.01) |

(52) U.S. Cl.

CPC ..... *H04R 29/006* (2013.01); *H04R 1/406* (2013.01); *H04R 3/005* (2013.01); *H04R 25/407* (2013.01); *H04R 2430/03* (2013.01)

USPC ..... 381/92; 381/122; 381/111

(58) Field of Classification Search

CPC ..... H04R 1/02; H04R 3/00

USPC ..... 381/91–92, 122, 111

See application file for complete search history.

(56) References Cited

U.S. PATENT DOCUMENTS

| | | | | |
|---|---|---|---|---|
| 8,270,634 | B2 * | 9/2012 | Harney et al. | 381/94.5 |
| 8,385,562 | B2 * | 2/2013 | Jeong et al. | 381/92 |

(Continued)

FOREIGN PATENT DOCUMENTS

| | | | |
|---|---|---|---|
| JP | 06-261390 | A | 9/1994 |
| JP | 2001-177900 | A | 6/2001 |
| JP | 2003-324789 | A | 11/2003 |
| JP | 2004-289762 | A | 10/2004 |

(Continued)

OTHER PUBLICATIONS

International Search Report for PCT/JP2011/003427 dated Aug. 9, 2011.

*Primary Examiner* — Disler Paul

(74) *Attorney, Agent, or Firm* — Pearne & Gordon LLP

(57) ABSTRACT

A directional microphone apparatus and directivity control method that corrects a level difference and a phase difference generated in a low band in a plurality of non-directional microphone units, improve the directivity, and reduce the size are provided. Level difference calculation section (105) calculates the level difference between first signal x1(*t*) obtained by first non-directional microphone unit (101) and second signal x2(*t*) obtained by second non-directional microphone unit (102), and correction parameter calculation section (106) calculates coefficients of a linear IIR filter configuring correction process section (103) based on the level difference. Correction process section (103) simultaneously corrects the level difference and a phase difference in the low band between two non-directional microphone units by using the calculated coefficients.

10 Claims, 24 Drawing Sheets

(56) References Cited

U.S. PATENT DOCUMENTS

| | | | | |
|---|---|---|---|---|
| 8,503,697 | B2 * | 8/2013 | Amada | 381/104 |
| 2004/0165735 | A1 | 8/2004 | Opitz | |
| 2008/0130918 | A1 * | 6/2008 | Kimijima | 381/107 |
| 2008/0192957 | A1 * | 8/2008 | Kubo | 381/103 |

FOREIGN PATENT DOCUMENTS

| | | | |
|---|---|---|---|
| JP | 2004-343700 | A | 12/2004 |
| JP | 2007-065091 | A | 3/2007 |
| JP | 2007-311850 | A | 11/2007 |
| JP | 2010-263280 | A | 11/2010 |

* cited by examiner

| SENSITIVITY DIFFERENCE | COEFFICIENT a | COEFFICIENT b |
|---|---|---|
| d1 | a1 | b1 |
| d2 | a2 | b2 |
| : | : | : |
| dm | am | bm |
| : | : | : |
| dn | an | bn |

FIG.4

DIRECTIONAL MICROPHONE DEVICE AND DIRECTIVITY CONTROL METHOD

TECHNICAL FIELD

The present invention relates to a directional microphone apparatus having a plurality of non-directional microphone units, and a directivity control method thereof.

BACKGROUND ART

A directional microphone apparatus that processes signals obtained from a plurality of non-directional microphone units to acquire directivity is known. As one method of this signal processing, there is a pressure-gradient directivity synthesis method. This synthesis method has an advantage in that the directivity can be formed even with the microphone units being arranged relatively in a small scale, whereas on the other hand has a defect in that the directivity is deteriorated when there are individual differences such as a level difference and a phase difference between the microphone units.

The level difference and the phase difference between the microphone units occur especially in a low band, due to an influence of air leakage and the like from a gap which is generated in a swaged section at a back side of the microphone unit due to a variation in mass-production or aging. Thus, the level difference and the phase difference still exist at a larger or smaller degree, even among the microphone units which quality is guaranteed by having undergone an inspection procedure at the time of shipment.

For example, Patent Literature 1 discloses a directional microphone apparatus that corrects only the level difference between two non-directional microphones by using levels of respective level of low band components of the two non-directional microphone units. FIG. 1 illustrates a configuration of the directional microphone apparatus disclosed in Patent Literature 1. FIG. 1A illustrates a case in which the level difference is corrected by a feedback, and FIG. 1B illustrates a case in which the level difference is corrected by a feedforward. Here, an explanation will be given using FIG. 1A.

In FIG. 1A, firstly, first and second non-directional microphones 11 and 12 pick up first and second signals. Next, level control circuit 19 performs level control on the second signal. Next, level control signal forming circuit 20 detects a level difference in the low band components between the first signal and the level-controlled second signal, and generates a level control signal corresponding to this level difference. Finally, level control circuit 19 controls by using the generated level control signal so as to remove the level difference between the first and second signals.

Further, for example, Patent Literature 2 discloses a directional microphone apparatus that plays learning signals from a speaker provided within the apparatus and performs calibration of microphone units. FIG. 2 illustrates a configuration of the directional microphone apparatus disclosed in Patent Literature 2.

In FIG. 2, firstly, signal processor 29 plays periodic noise signals that were set in advance, via amplifier 26 and from speakers 25 provided within detection areas of microphone units 21 to 24. Next, a digital FIR (Finite Impulse Response) filter in signal processor 29 performs filtering process on each signal picked up in microphone units 21 to 24. Finally, signal processor 29 is configured to evaluate a response from the digital FIR filter, adapt a characteristic of the digital FIR filter, and perform calibration of microphone units 21 to 24.

Further, for example, Patent Literature 3 discloses a directional microphone apparatus that adjusts frequency characteristic in a low band based on a sensitivity difference between two non-directional microphone units. FIG. 3 illustrates a configuration of the directional microphone apparatus disclosed in Patent Literature 3.

In FIG. 3, firstly, first and second non-directional microphones 11 and 12 pick up first and second signals. Next, first and second HPFs 30 and 31 perform high-pass filtering process on each of the first and second signals. Next, first and second BPFs 32 and 33 perform band-pass process that allows only frequency components in a particular band to pass on each of the first and second signals to which the high-pass filtering process has been performed. Next, sensitivity difference comparator 34 calculates which of the sensitivity differences of the first and second signals retaining only the frequency components in the particular band is larger. Finally, coefficient generating section 35 generates a coefficient of the HPF of the larger one of the first and second signal retaining only the frequency components in the particular band, based on the sensitivity difference. Here, as illustrated in FIG. 4, coefficient generating section 35 generates coefficients of a1 to an as coefficient a and coefficients of b1 to bn as coefficient b, according to the sensitivity differences d1 to dn (n being a positive number).

CITATION LIST

Patent Literature

PTL 1
Japanese Patent Application Laid-Open No. 2001-177900
PTL 2
Japanese Patent Application Laid-Open No. 2004-343700
PTL 3
Japanese Patent Application Laid-Open No. 2010-263280

SUMMARY OF INVENTION

Technical Problem

However, in the configuration disclosed in the aforementioned

Patent Literature 1, since only the level difference between two non-directional microphones is corrected, a phase difference is not corrected; so that in a case where directivity is desired even in the low band, there is a problem that an improvement thereof is not sufficient.

Further, in the configuration disclosed in Patent Literature 2, although the directivity can be obtained even in the low band, it is necessary to play the learning signals for the calibration of the microphone units, and in assuming a use in a compact consumer product, it is difficult to provide a speaker for the playing. Further, in a case where it is possible to provide the speaker, there is a problem that a user is forced to endure the responsibility of performing the calibration.

Further, in the configuration disclosed in Patent Literature 3, since one of the non-directional microphones is adjusted to the other of the non-directional microphones having lower sensitivity in the particular band, there is a problem that an attenuation of an amplitude frequency characteristic in the low band is incurred.

Accordingly, especially in the configurations disclosed in Patent Literature 1 and Patent Literature 3, there is a problem that the amplitude frequency characteristic in the low band is not improved.

It is therefore an object of the present invention to provide a directional microphone apparatus and directivity control method that correct the level difference and the phase difference generated in the low band in the plurality of non-directional microphone units, improve the directivity, and reduce the size.

Solution to Problem

A directional microphone apparatus of the present invention employs a configuration including: a plurality of non-directional microphone units; a correction process section that corrects a plurality of signals obtained by the plurality of non-directional microphone units by using a correction parameter; a directivity synthesis section that performs directivity synthesis by using the plurality of signals corrected; a level difference calculation section that calculates a level difference in the plurality of non-directional microphone units; and a correction parameter calculation section that calculates the correction parameters based on the level difference, the correction parameters for correcting simultaneously the level difference and phase difference in the plurality of non-directional microphone units in the correction process section.

Further, a directional microphone apparatus of the present invention employs a configuration including: a plurality of non-directional microphone units; a correction process section that corrects a plurality of signals obtained by the plurality of non-directional microphone units by using a correction parameter; a directivity synthesis section that performs directivity synthesis by using the plurality of signals corrected; a level comparing section that compares a level of a signal that is a reference with levels of other signals among the plurality of signals corrected; and a correction parameter update section that updates the correction parameters based on the level comparison result, the correction parameters for correcting simultaneously a level difference and a phase difference in the plurality of non-directional microphone units in the correction process section.

Further, a directivity control method of the present invention includes: a correction processing step of correcting a plurality of signals obtained by a plurality of non-directional microphone units by using a correction parameter; a directivity synthesis step of performing directivity synthesis by using the plurality of signals corrected; a level difference calculating step of calculating a level difference between the plurality of non-directional microphone units; and a correction parameter calculating step of calculating the correction parameters based on the level difference, the correction parameters for correcting simultaneously the level difference and a phase difference among the plurality of non-directional microphone units in the correction processing step.

Further, a directivity control method of the present invention includes: a correction processing step of correcting by using a correction parameter a plurality of signals obtained by a plurality of non-directional microphone units; a directivity synthesis step of performing directivity synthesis by using the plurality of signals corrected; a level comparing step of comparing among the plurality of signals corrected a level of a signal that is to be a reference with levels of other signals; and a correction parameter updating step of updating the correction parameters based on the level comparison result, wherein the correction parameters in the correction processing step simultaneously correct a level difference and a phase difference in the plurality of non-directional microphone units.

Advantageous Effects of Invention

According to the present invention, it is possible to correct the level difference and the phase difference generated in the low band in the plurality of non-directional microphone units, improve the directivity, and reduce the size.

BRIEF DESCRIPTION OF DRAWINGS

FIG. 4 is an image drawing of coefficients of a high-pass filter generated in a coefficient generating section in the directional microphone apparatus illustrated in FIG. 3;

DESCRIPTION OF EMBODIMENTS

Figure 1A:
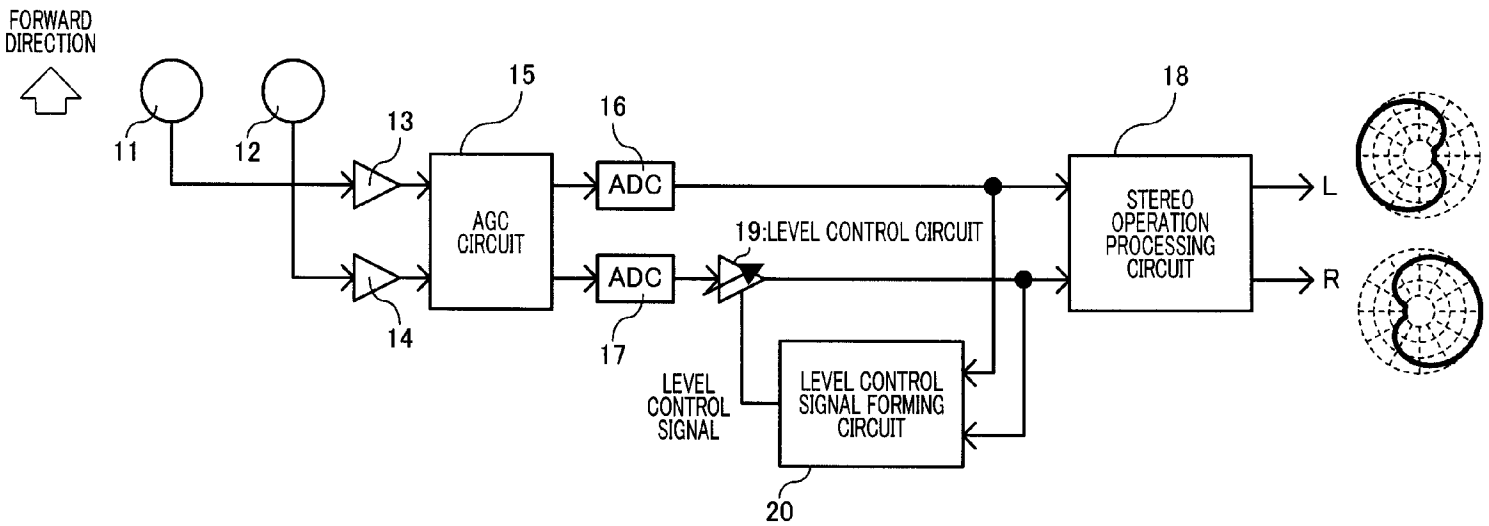
FIG. 1 illustrates a configuration of a directional microphone apparatus disclosed in Patent Literature 1.
Figure 1B:
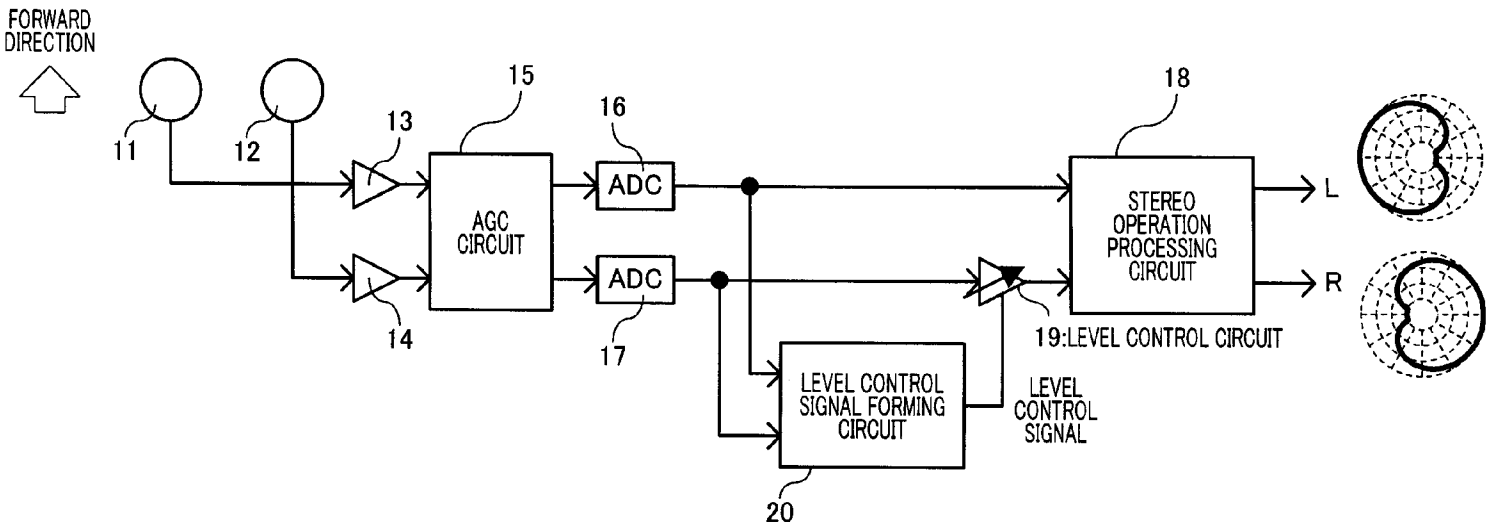
Figure 2:
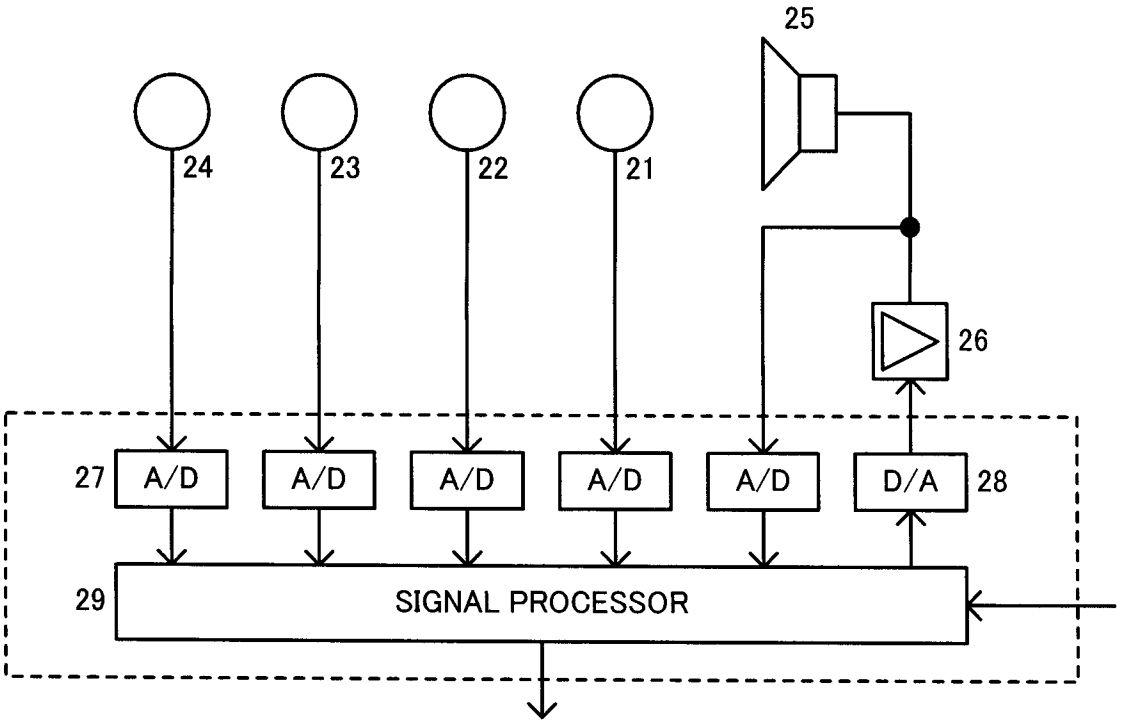
FIG. 2 illustrates a configuration of the directional microphone apparatus disclosed in Patent Literature 2.
Figure 3:
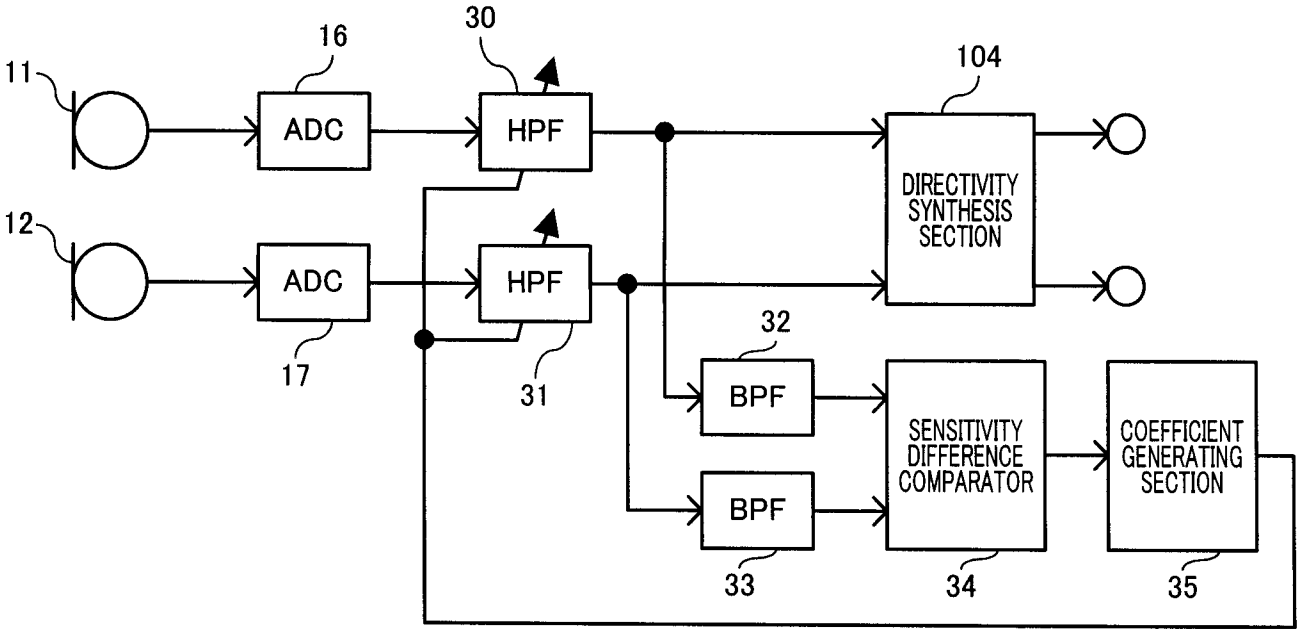
FIG. 3 illustrates a configuration of the directional microphone apparatus disclosed in Patent Literature 3.

Hereinafter, embodiments of the present invention will be explained with reference to the drawings. Here, in the embodiments, configurations having the same function will be assigned the same reference numerals, and duplicated explanations will be omitted.

(Embodiment 1)

Figure 5:
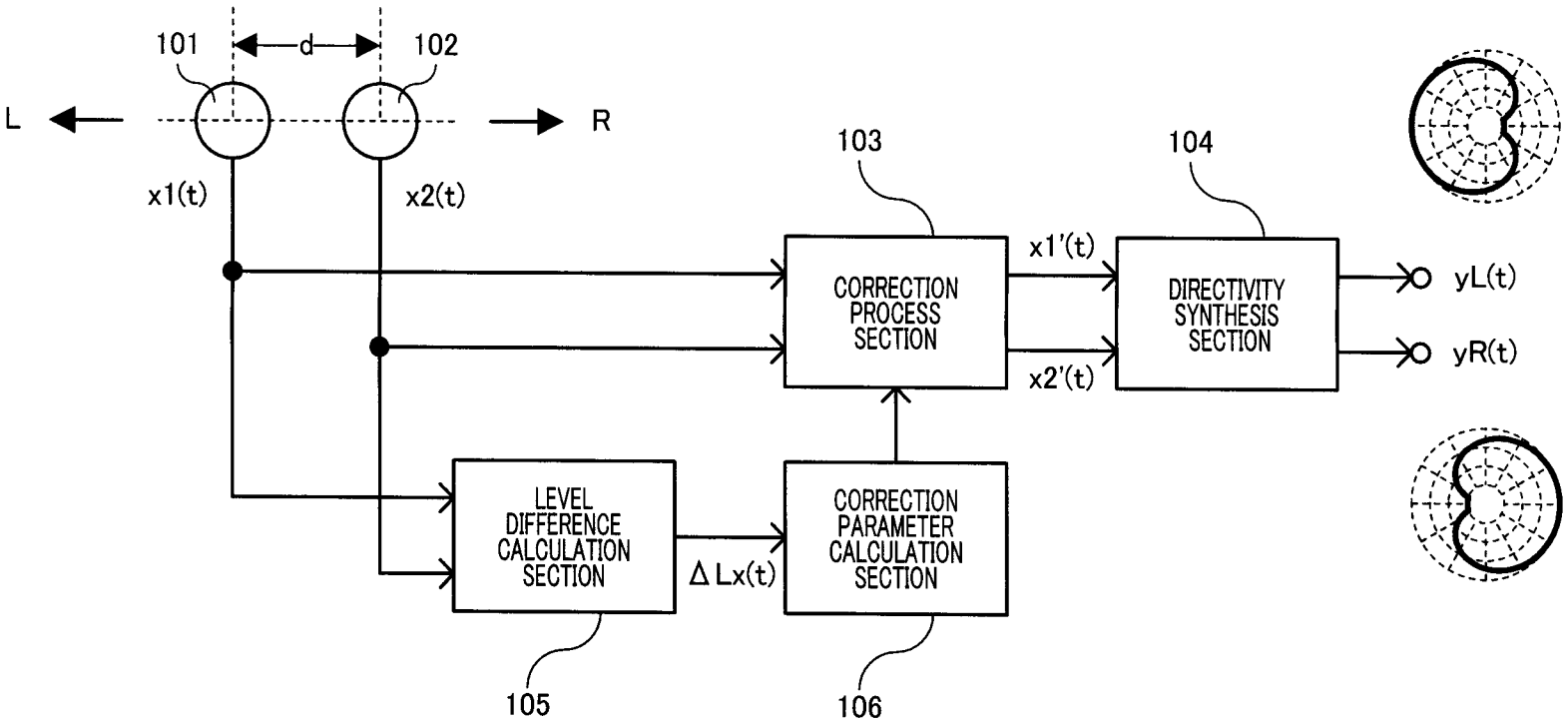
FIG. 5 illustrates a configuration of a directional microphone apparatus of embodiment 1 of the present invention.

FIG. 5 illustrates a configuration of a directional microphone apparatus of embodiment 1 of the present invention. The configuration of the directional microphone apparatus will be explained with reference to FIG. 5 below.

First non-directional microphone unit 101 and second non-directional microphone unit 102 are built in an apparatus such as a video camera, a hearing aid and the like by separating from each other by interval d. The interval d is an arbitrary value that is determined by restrictions on necessary frequency bands and an installed space. Here, a range of about d=5 mm to 30 mm will be considered in view of the frequency bands. First non-directional microphone unit 101 outputs first signal x1(*t*) to correction process section 103 and level difference calculation section 105 respectively. Further, second non-directional microphone unit 102 outputs second signal x2(*t*) to correction process section 103 and level difference calculation section 105 respectively.

Figure 6:
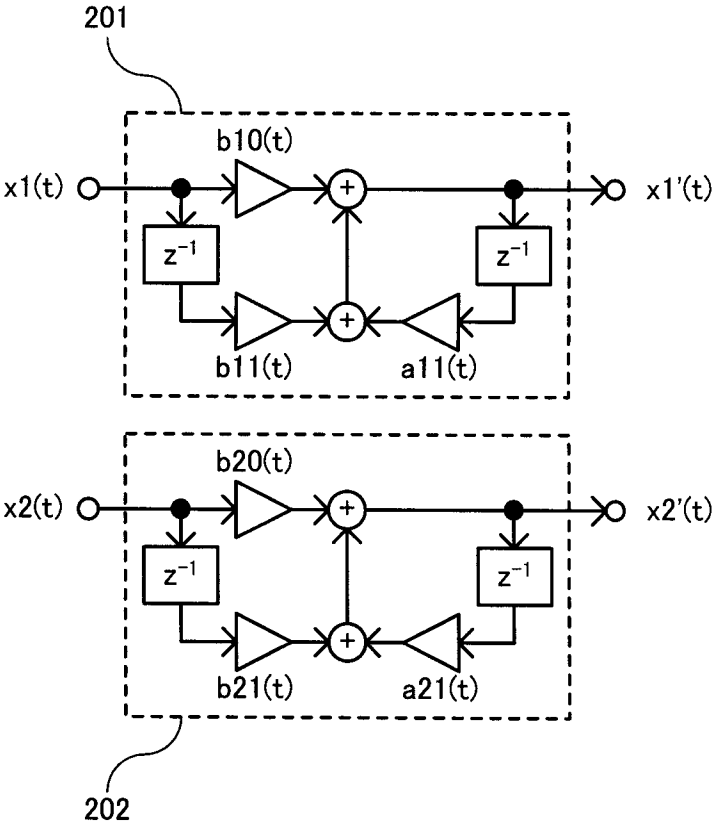
FIG. 6 illustrates an internal configuration of the correction process section illustrated in FIG. 5.

Correction process section 103 simultaneously corrects a level difference and a phase difference between two non-directional microphone units by using a correction parameter calculated in correction parameter calculation section 106 (described later). Specifically, correction process section 103 has a configuration illustrated in FIG. 6, and first linear IIR (Infinite Impulse Response) filter 201 receives as input first signal x1(*t*) and outputs first filter output signal x1'(*t*). Further, second linear IIR filter 202 receives as input second signal x2(*t*) and outputs second filter output signal x2'(*t*). The correction parameters calculated by correction parameter calculation section 106 are coefficients b10(*t*), b11(*t*) and a11(*t*) of the first linear IIR filter and coefficients b20(*t*), b21(*t*) and a21(*t*) of the second linear IIR filter. First filter output signal x1'(*t*) and second filter output signal x2'(*t*) in which the level difference and the phase difference have been corrected are output to directivity synthesis section 104.

In order to avoid deterioration in sound quality due to switching of the filter coefficients, there is a case in which smoothing is performed by equation 1.

$$b10(t)=(1-\gamma)\cdot b10'(t)+\gamma\cdot b10(t-1)$$

$$b11(t)=(1-\gamma)\cdot b11'(t)+\gamma\cdot b11(t-1)$$

$$a11(t)=(1-\gamma)\cdot a11'(t)+\gamma\cdot a11(t-1)$$

$$b20(t)=(1-\gamma)\cdot b20'(t)+\gamma\cdot b20(t-1)$$

$$b21(t)=(1-\gamma)\cdot b21'(t)+\gamma\cdot b21(t-1)$$

$$a21(t)=(1-\gamma)\cdot a21(t)+\gamma\cdot a21(t-1) \quad \text{(Equation 1)}$$

In equation 1, the coefficients calculated in correction parameter calculation section 106 are b10'(*t*), b11'(*t*), a11'(*t*), b20'(*t*), b21'(*t*), and a21'(*t*). However, γ is a time constant, and takes a value in $0 \leq \gamma < 1$.

Figure 7:
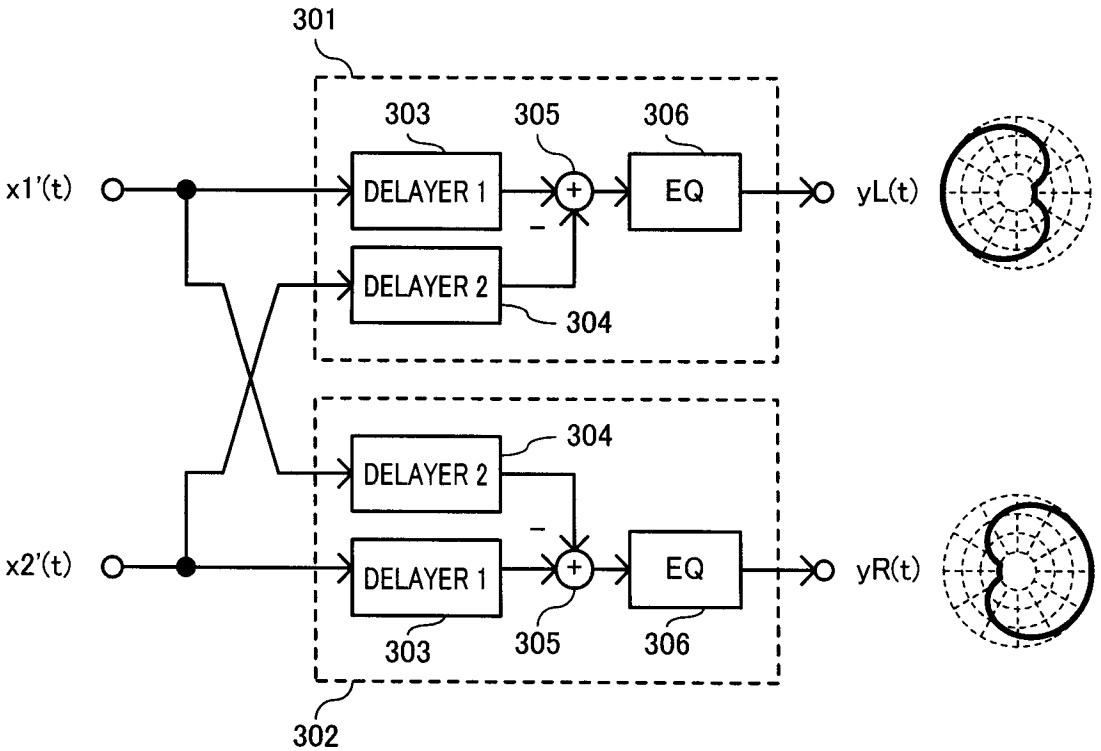
FIG. 7 illustrates an internal configuration of the directivity synthesis section illustrated in FIG. 5.

As illustrated in FIG. 7, directivity synthesis section 104 includes left side directivity synthesis section 301 and right side directivity synthesis section 302. Directivity synthesis section 104 performs directivity synthesis by using first filter output signal x1'(*t*) and second filter output signal x2'(*t*) output from correction process section 103.

Left side directivity synthesis section 301 includes first delayer 303, second delayer 304, subtractor 305 and EQ (Equalizer) 306, and forms a directivity in an L direction in FIG. 5.

First delayer 303 inputs first filter output signal x1'(*t*), and second delayer 304 inputs second filter output signal x2'(*t*). The coefficients of first delayer 303 and second delayer 304 are designed such that first filter output signal x1'(*t*) and second filter output signal x2'(*t*) with respect to a sound wave that arrives from an R direction in FIG. 5 become, for example, in-phase. Specifically, the coefficients of first delayer 303 and second delayer 304 are respectively designed such that second filter output signal x2'(*t*) relative to first filter output signal x1'(*t*) relatively delays by d/c [s]. Note that, d is a microphone interval [m], and c is a speed of sound [m/s].

Subtractor 305 subtracts the output of second delayer 304 from the output of first delayer 303, and forms a blind area of the directivity in the R direction, that is, obtains a signal with high sensitivity of directivity in the directivity relatively in the L direction. The output signal of subtractor 305 has amplitude frequency characteristic having a gradient of −6 dB/Octave as the frequency fundamentally becomes lower in the L direction, so that EQ 306 performs correction of the output signal of subtractor 305 such that the amplitude frequency characteristic smooths.

Right side directivity synthesis section 302 forms directivity in the R direction in FIG. 5. Right side directivity synthesis section 302 differs from left side directivity synthesis section 301 only in the input signal, and has the same configuration and the same operation, so that the detailed explanation will be omitted.

Figure 8:
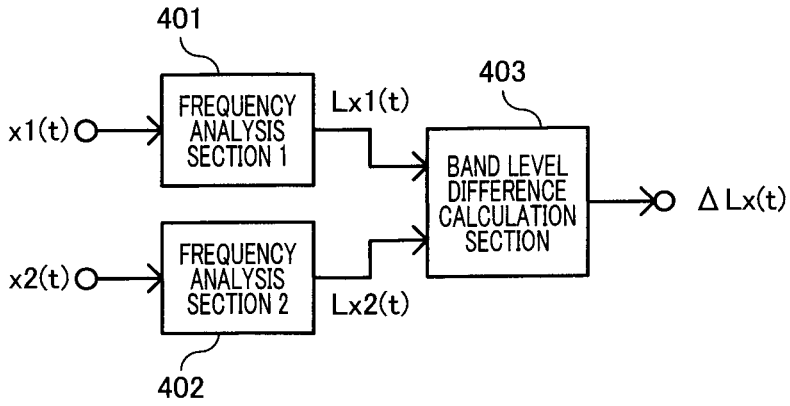
FIG. 8 illustrates an internal configuration of the level difference calculation section illustrated in FIG. 5.

As illustrated in FIG. 8, level difference calculation section 105 includes first frequency analysis section 401, second frequency analysis section 402, and band level difference calculation section 403. Level difference calculation section 105 calculates the level difference between first signal x1(*t*) obtained by first non-directional microphone unit 101 and second signal x2(*t*) obtained by second non-directional microphone unit 102. The level difference is calculated for an arbitrary frequency band lower than around 200 Hz, where the level difference and the phase difference between the microphone units are likely to occur due to an influence of air leakage and the like from a gap in a swaged section at a back side of the microphone units.

Figure 9:
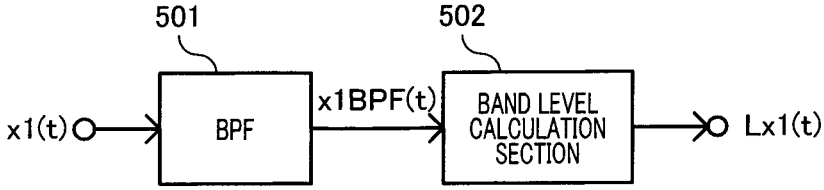
FIG. 9 illustrates an internal configuration of a first frequency analysis section illustrated in FIG. 8.

As illustrated in FIG. 9, first frequency analysis section 401 includes band-pass filter (BPF) 501 and band level calculation section 502. First frequency analysis section 401 calculates first band level Lx1(*t*) of first signal x1(*t*) obtained by first non-directional microphone unit 101, and outputs the result to band level difference calculation section 403.

Figure 10:
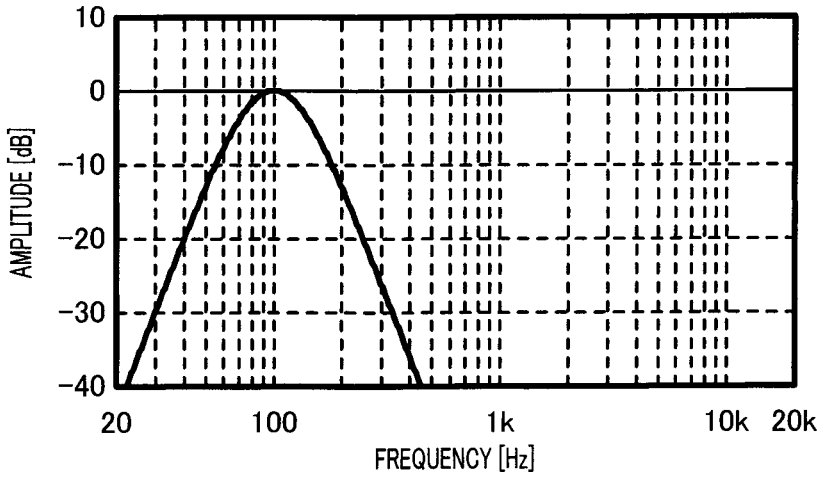
FIG. 10 illustrates amplitude frequency characteristic of a band-pass filter configured of an IIR filter.

Band-pass filter 501 is configured of an IIR filter or an FIR filter, and extracts band signals for calculating the level difference necessary for the calculation of the correction parameters in correction parameter calculation section 106. That is, band-pass filter 501 performs band-limiting of first signal x1(*t*), and outputs first signal x1BPF(t) to band level calculation section 502. FIG. 10 illustrates an example of the amplitude frequency characteristic of band-pass filter 501 configured of the IIR filter with a center frequency of 100 Hz.

Band level calculation section 502 calculates first band level Lx1(*t*) [dB] by using first band signal x1BPF(t) output from band-pass filter 501. Equation 2 is an example of a calculation equation of Lx1(*t*).

$$Lx1(t)=20*\log_{10}\{(1-\tau)\cdot|x1_{BPF}(t)|+\tau\cdot 10^{Lx1(t-1)/20}\} \quad \text{(Equation 2)}$$

In equation 2, τ is a time constant, and takes a value in $0\leq\tau<1$.

Second frequency analysis section 402 calculates second band level Lx2(*t*) of second signal x2(*t*) obtained by second non-directional microphone unit 102, and outputs the result to band level difference calculation section 403. Second frequency analysis section 402 differ from first frequency analysis section 401 only in its input signal and has the same configuration and the same operation, so that the detailed explanation will be omitted.

Band level difference calculation section 403 calculates level difference ΔLx(t) between first band level Lx1(*t*) output from first frequency analysis section 401 and second band level Lx2(*t*) output from second frequency analysis section 402. Next, band level difference calculation section 403 outputs calculated level difference ΔLx(t) to correction parameter calculation section 106. Equation 3 is an example of a calculation equation of level difference ΔLx(t) [dB].

$$\Delta Lx(t)=Lx1(t)-Lx2(t) \quad \text{(Equation 3)}$$

Correction parameter calculation section 106 calculates correction parameters that simultaneously correct the level differences and the phase differences in the low band existing between two non-directional microphone units, based on level difference ΔLx(t) output from level difference calculation section 105. Correction parameter calculation section 106 outputs the calculated correction parameters to correction process section 103.

Here, a hypothesis in which the simultaneous correction of the level difference and the phase difference in the low band between two non-directional microphone units is enabled by the linear IIR filter composing correction process section 103 will be explained.

First, the explanation below analyzes a phenomenon of air leakage from a gap from a swaged section on a back side of an non-directional microphone unit by using the structure of the non-directional microphone unit and an equivalent circuit thereof.

Figure 11A:
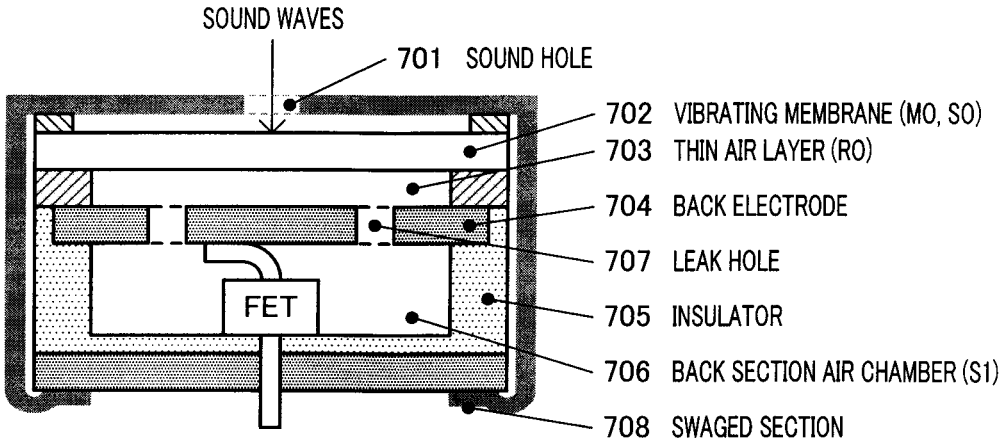
FIG. 11 illustrates a structure of an non-directional microphone unit having no air leakage.

FIG. 11A illustrates the structure of an non-directional microphone unit having no air leakage. The non-directional microphone unit includes vibrating membrane 702 that vibrates by receiving sound pressure of sound waves from sound hole 701, back electrode 704, and insulator 705 supporting back electrode 704. Further, back electrode 704 separates uniform air layer (thin air layer 703) of several 10 to 100 μm in a back of vibrating membrane 702, and forms capacitance by opposing in parallel to vibrating membrane 702. Further, at the non-directional microphone unit, a back side of vibrating membrane 702 is sealed by back electrode 704 and insulator 705.

However, the non-directional microphone unit has back section air chamber 706 for balancing atmospheric pressure on both sides of vibrating membrane 702 and leak hole 707 communicating with back section air chamber 706, so that a position of vibrating membrane 702 is not biased due to the change of atmospheric pressure.

An electret film is attached to a surface of back electrode 704, and the non-directional microphone unit generates a strong direct current electric field between vibrating membrane 702 and back electrode 704. Consequently, in the non-directional microphone unit, the interval (capacitance) between vibrating membrane 702 and back electrode 704 changes according to the vibration of vibrating membrane 702 and electric signals proportionate to the change in the sound pressure can be obtained.

Figure 11B:
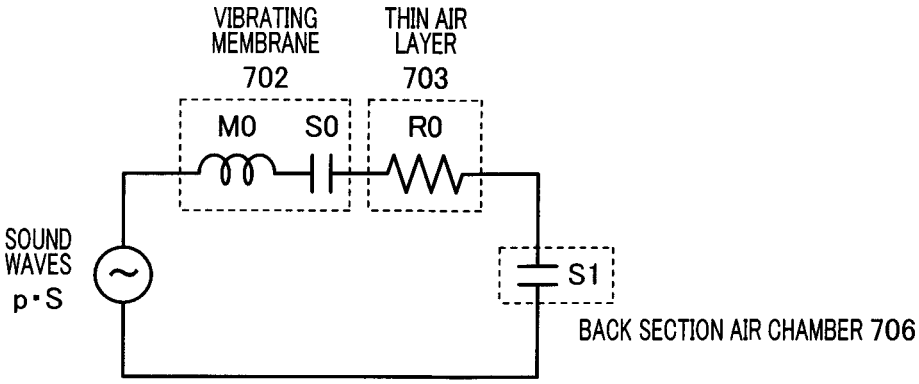

FIG. 11B simplifies and illustrates an equivalent circuit of the non-directional microphone unit illustrated in FIG. 11A. Force applied to vibrating membrane 702 is, p·S, where the sound pressure applied to vibrating membrane 702 is p, and an effective area of vibrating membrane 702 is S. In FIG. 11B, suppose S0 is a stiffness of vibrating membrane 702, M0 is a mass of vibrating membrane 702, R0 is a viscous resistance of thin air layer 703, and S1 is a stiffness of back section air chamber 706.

Figure 12A:
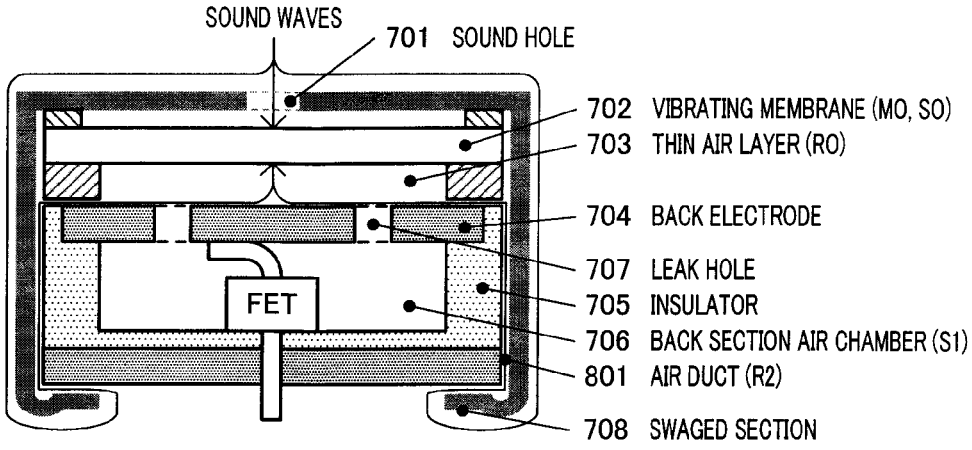
FIG. 12 illustrates a structure of an non-directional microphone unit having air leakage.

On the other hand, FIG. 12A illustrates the structure of an non-directional microphone unit having air leakage. If air is leaking, in addition to the sound pressure from sound hole 701, sound pressure by sound waves from air duct 801 formed by the gap of swaged section 708 from the back side is added to vibrating membrane 702.

Figure 12B:
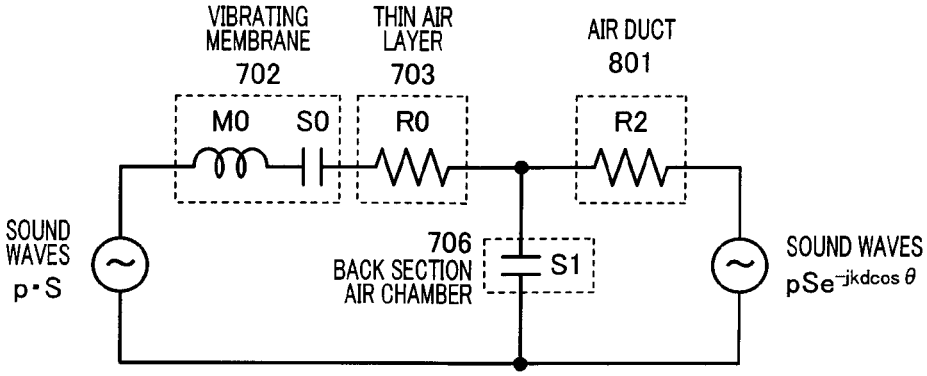

FIG. 12B simplifies and illustrates an equivalent circuit of the non-directional microphone unit illustrated in FIG. 12A. The equivalent circuit of FIG. 12B differs from the equivalent circuit of FIG. 11B in the following two points. The first differing point is that force $p\cdot S\cdot\exp(-j\cdot k\cdot d\cdot\cos\theta)$ is added to the gap of swaged section 708. However, $-j\cdot k\cdot d\cdot\cos\theta$ means a phase delay. Further, k indicates a wavenumber (=2π/wavelength), and $d\cdot\cos\theta$ indicates a distance difference of sound waves arriving to vibrating membrane 702 from sound hole 701. A second difference is that equivalent resistance R2 of air duct 801 from the gap of swaged section 708 to the back side of vibrating membrane 702 is provided.

From FIG. 12B, it is assumed that the sound wave arriving from the gap of swaged section 708 to the back side of vibrating membrane 702 passes through a linear low-pass filter formed by equivalent resistance R2 of air duct 801 and stiffness S1 of back section air chamber 706. Vibrating membrane 702 is driven by the sound waves from sound hole 701, and the sound waves that had passed through the linear low-pass filter from the gap of swaged section 708. Further, the output of the non-directional microphone unit is the result that sound pressure difference thereof is converted into an electric signal.

Thus, in comparing FIG. 11B and FIG. 12B, the output signal in the case with the air leakage is a linear high-pass characteristic that is a difference between the sound wave from sound hole 701 (assumed as a flat frequency characteristic) and the sound wave having the linear low-pass characteristic from the gap of swaged section 708. By this means, in the case with the air leakage, it is assumed that the levels in the low band decreases compared to units not having the air leakage and results in the characteristic with delayed phase.

Figure 13:
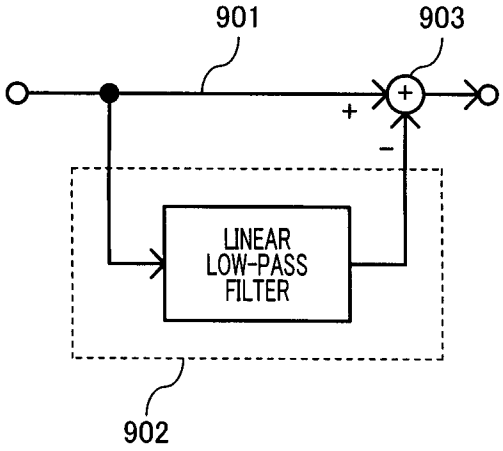
FIG. 13 illustrates a configuration in which the non-directional microphone unit having the air leakage is simulated by a digital filter.

FIG. 13 illustrates a configuration where this non-directional microphone unit having the linear high-pass characteristic and the air leakage, is simulated by a digital filter. In FIG. 13, first signal line 901 equals to a route of a sound wave from sound hole 701 to vibrating membrane 702, and second signal line 902 equals to a route of a sound wave (having the linear low-pass filter) from the gap of swaged section 708 to vibrating membrane 702, respectively. Further, in FIG. 13, subtractor 903 equals to vibrating membrane 702. That is, in the configuration simulated by the digital filter, the sound pressure difference between the sound wave from sound hole 701 and the sound wave from the gap of swaged section 708 at vibrating membrane 702 becomes the output signal. Consequently, the configuration simulated by the digital filter is configured to subtract the signal in second signal line 902 from the signal in first signal line 901, by subtractor 903.

In next explanation, the digital filter illustrated in FIG. 13 compares a measured value in the non-directional microphone unit to a calculated value to which calculator simulation has been performed.

Figure 14A:
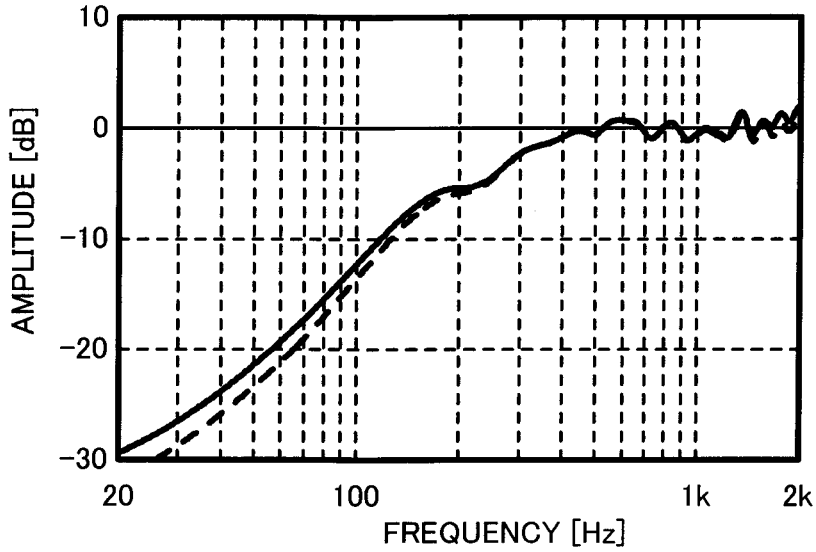
FIG. 14 illustrates measured values in the frequency characteristics of the non-directional microphone unit having no air leakage and the non-directional microphone unit having the air leakage.
Figure 14B:
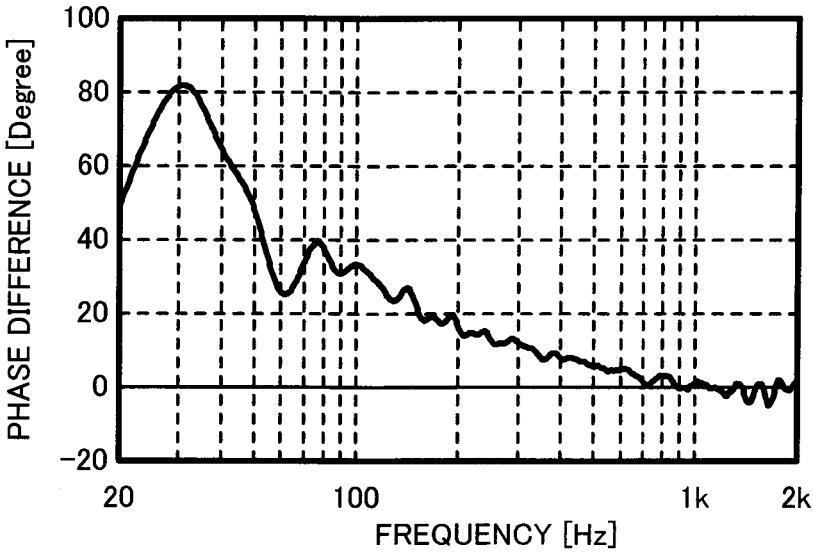

FIG. 14 illustrates examples of the measured values in the frequency characteristic of the non-directional microphone unit having no air leakage and the non-directional microphone unit having the air leakage. FIG. 14A illustrates the amplitude frequency characteristic of respective one of the two non-directional microphone units, where a solid line illustrates the characteristic of the non-directional microphone unit without the air leakage, and a dotted line illustrates the characteristic of the non-directional microphone unit with the air leakage, respectively. As illustrated in FIG. 14A, it is possible to confirm that in the unit with the air leakage, the level in the low band decreases, compared to the unit without the air leakage. FIG. 14B illustrates the frequency characteristic of the phase difference between two non-directional microphone units, against the reference of the non-directional microphone unit without the air leakage. As illustrated in FIG. 14B, it is possible to confirm that in the unit with the air leakage, the phase in the low band delays.

Figure 15A:
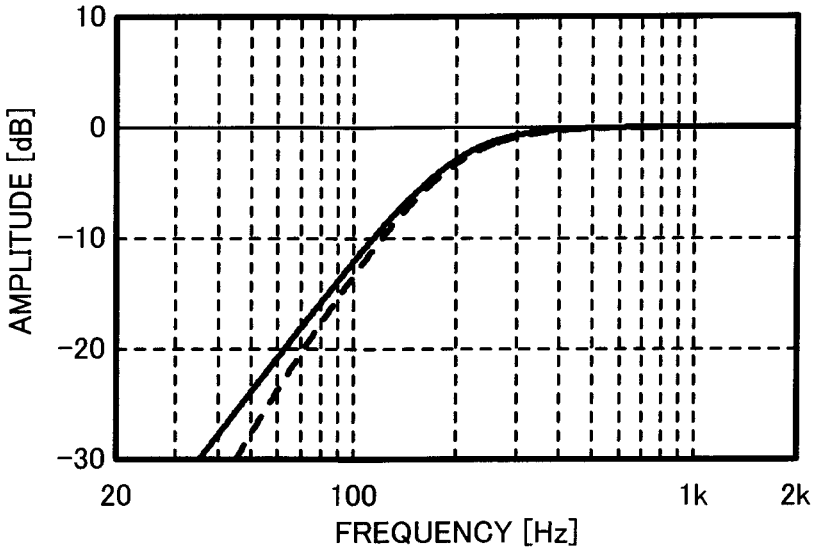
FIG. 15 illustrates calculated values by the digital filter of FIG. 13 simulating the frequency characteristics of FIG. 14
Figure 15B:
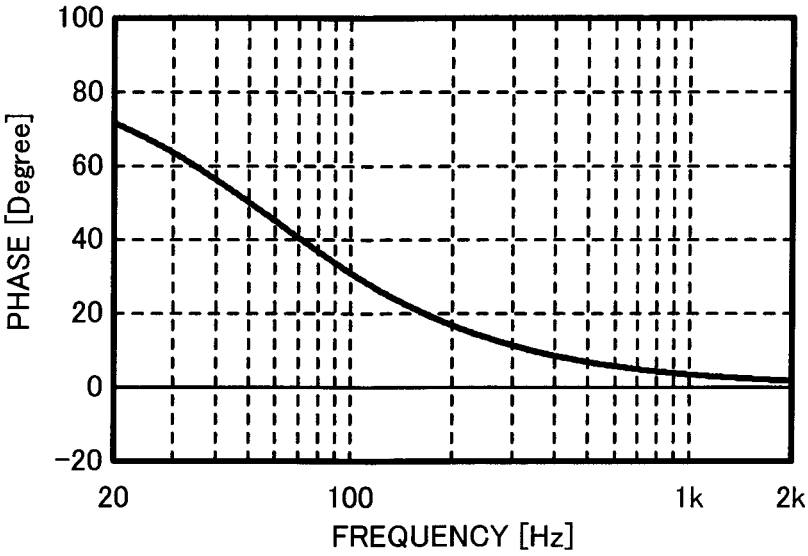

FIG. 15 illustrates the calculated values by the digital filter of FIG. 13 simulating the frequency characteristic of FIG. 14. In FIG. 15A, a solid line illustrates a characteristic only of signal line 901 illustrated in FIG. 13 (equal to the unit without the air leakage), and a dotted line illustrates an output characteristic of subtractor 903, respectively. As illustrated in FIG. 14 and FIG. 15, in the lowest band, it is possible to confirm that a satisfactory correspondence is obtained for the most part, although there is a difference between the measured value and the calculated value due to an influence of measurement error and the like.

The amplitude frequency characteristic is a characteristic that multiplies a low-cut filter.

According to the above explanation, it is possible to realize a simultaneous correction of the level difference and the phase difference in the low band between two non-directional microphone units. Specifically, it is possible to realize the simultaneous correction of the level difference and the phase difference in the low band, by multiplying a linear IIR filter having an inverse characteristic of the digital filter in FIG. 13 to the signal from the non-directional microphone unit with the air leakage. Correction parameter calculation section 106 calculates the coefficient of the linear IIR filter having an inverse characteristic of the digital filter in FIG. 13.

Next, in view of the above hypothesis, an operation of correction parameter calculation section 106 will be explained. Correction parameter calculation section 106 calculates the coefficient of the linear IIR filter that simultaneously corrects the level difference and the phase difference in the low band between two non-directional microphone units. Specifically, correction parameter calculation section 106 calculates b11($t$), a11($t$), b21($t$), and a21($t$) among the coefficients of first linear IIR filter 201 and the coefficients of second linear IIR filter 202 configuring correction process section 103. Note that, suppose the next coefficients are b10($t$)=b20($t$)=1.

The calculation of the filter coefficients is performed based only on level difference ΔLx(t) calculated in level difference calculation section 105. The level difference and the phase difference in the low band between two non-directional microphone units caused by the presence/absence of the air leakage or by a degree of the air leakage have a one-to-one corresponding relationship. Consequently, correction parameter calculation section 106 can calculate the coefficient for performing the simultaneous correction of the level difference and the phase difference, by using the filter coefficients calculated based only on the level difference. Notably, embodiment 1 is a configuration for performing correction on non-directional microphone units with the air leakage.

In the case where level difference ΔLx(t) is equal to or lower than threshold Lth1 (Lth1≤0) [dB] (that is, ΔLx(t)≤Lth1), the coefficients b11($t$) and a11($t$) of first linear IIR filter 201 are calculated for correcting first signal x1($t$). On the other hand, b21($t$)=a21($t$)=0 is assumed in order to cause second linear IIR filter 202 to be a through filter.

In the case where level difference ΔLx(t) is equal to or lower than threshold Lth2 (Lth2≤0) [dB] (that is, ΔLx(t)≤Lth2), the coefficients b21($t$) and a21($t$) of second linear IIR filter 202 are calculated for correcting second signal x2($t$). On the other hand, suppose first linear IIR filter 201 is b11($t$)=a11($t$)=0 in order to be a through filter.

In the case where level difference ΔLx(t) is larger than threshold Lth1 and smaller than threshold Lth2, that is, in the case of Lth1<ΔLx(t)<Lth2, there is no level difference between two non-directional microphone units. In other words, it is possible to determine the level and the phase of the two non-directional microphone units as substantially equal. Thus, suppose first linear IIR filter 201 and second linear IIR filter 202 are b11($t$)=a11($t$)=0 and b21($t$)=a21($t$)=0 respectively, in order to be through filters.

Here, the calculation method of the filter coefficients will be described where the case of ΔLx(t)≥Lth2, that is, the case of calculating coefficients b21($t$) and a21($t$) of second linear IIR filter 202 is an example.

First, a21($t$) is set. Specifically, in assuming a21($t$)=−1, although ideal amplitude frequency characteristic and phase frequency characteristic can be obtained in the calculation, an oscillation occurs. Consequently, a21($t$) is set to be an arbitrary value that is somewhat larger than −1. Practically, the value is set according to a low band limit of a necessary frequency band.

Next, b21($t$) is calculated. With b21($t$) being calculated based on level difference ΔLx(t), second linear IIR filter 202 comes to have an amplitude frequency characteristic and a phase frequency characteristic in accordance with level difference ΔLx(t). Equation 4 is an example of a calculation equation of b21($t$).

$$b21(t) = a \cdot 10^{-\frac{|\Delta Lx(n)|}{20}} + b \qquad \text{(Equation 4)}$$

Figure 16A:
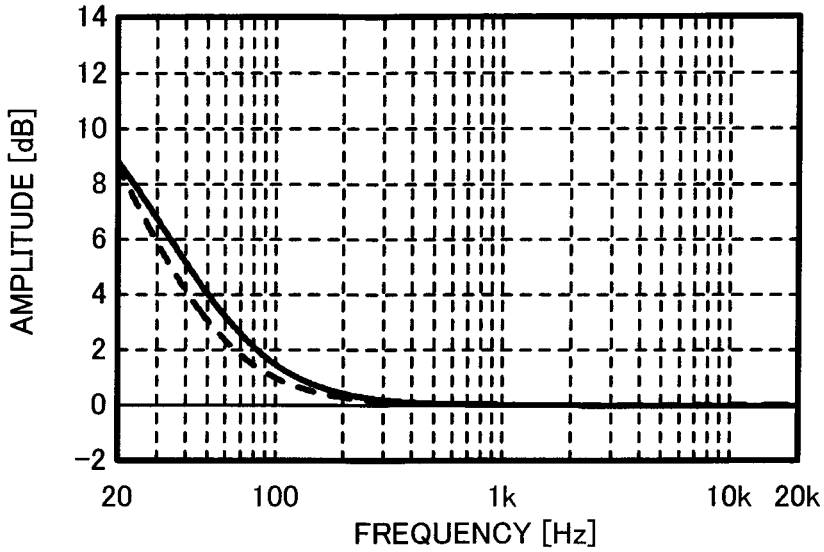
FIG. 16 illustrates amplitude frequency characteristic and phase frequency characteristic of a second linear IIR filter.
Figure 16B:
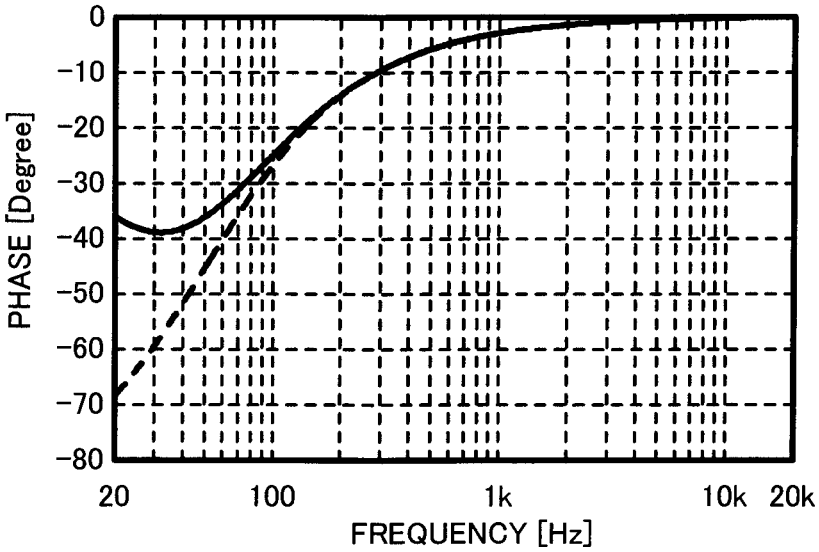
Figure 17A:
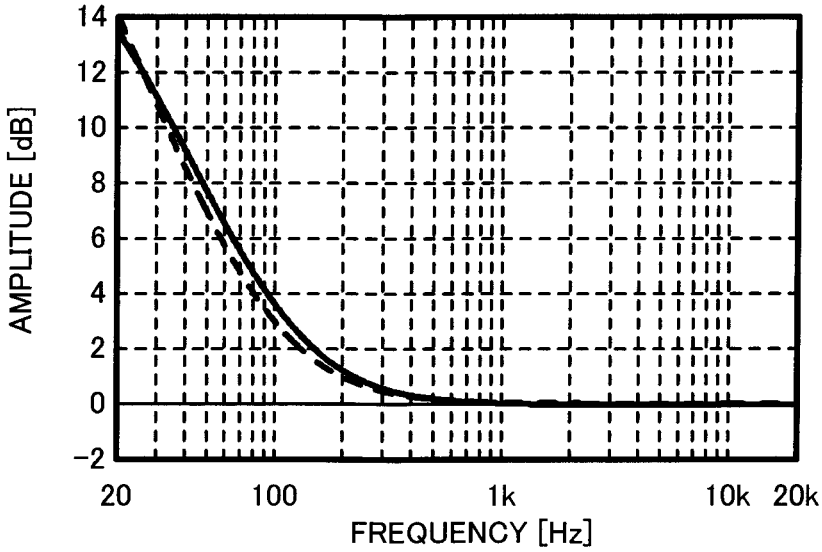
FIG. 17 illustrates the amplitude frequency characteristic and the phase frequency characteristic of the second linear IIR filter.
Figure 17B:
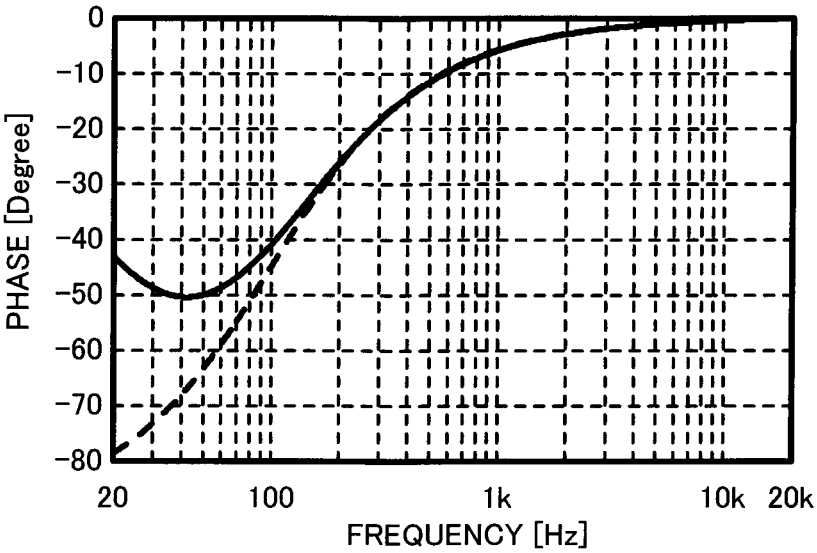

FIG. 16 and FIG. 17 illustrate, in the case of a21($t$)=−0.998, the amplitude frequency characteristic and the phase frequency characteristic of second linear IIR filter 202 using b21($t$) calculated experimentally based on equation 4, as an example. FIG. 16 illustrates the case of |ΔLx(t)|=1 [dB], and FIG. 17 illustrates the case of |ΔLx(t)|=3 [dB]. FIG. 16A and FIG. 17A illustrate the amplitude frequency characteristic, and FIG. 16B and FIG. 17B illustrate the phase frequency characteristic. Further, in FIG. 16 and FIG. 17, a solid line illustrates the characteristic calculated by using b21($t$) calculated experimentally based on equation 4, and a dotted line illustrates an ideal characteristic. Here, the ideal characteristic is calculated assuming a21($t$)=−1 (which oscillates in practice). As illustrated in FIG. 16 and FIG. 17, it is possible to confirm that the characteristics obtained by the present calculating method can obtain almost the same characteristics as the ideal characteristics in the frequency bands higher than around 200 Hz, which is expected as being in need of directivity in practice.

Of course, in the case of $\Delta Lx(t) \leq Lth1$, coefficients b11($t$) and a11($t$) of first linear IIR filter 201 may be calculated in a similar method.

Accordingly, the present embodiment utilizes that the non-directional microphone units with the air leakage has the linear high-pass characteristic, and the level difference and the phase difference in the low band has the one-to-one corresponding relationship between two non-directional microphone units with or without the air leakage. Further, the present embodiment calculates the coefficients of the linear IIR filter that performs the correction processing, based on the level difference in the low band between two non-directional microphone units. By this means, the present embodiment can simultaneously correct the level difference and the phase difference in the low band between two non-directional microphone units, and can suppress the deterioration of the directivity with a small amount of calculation.

Note that, although the present embodiment has exemplified the case where the number of the non-directional microphone units is two, it is equally possible to utilize three or more non-directional microphone units. In such a case, the correction parameters can be calculated in the similar method as above, based on the level differences between the respective non-directional microphone units that are calculated on the basis of the non-directional microphone unit having the highest band level.

Figure 18:
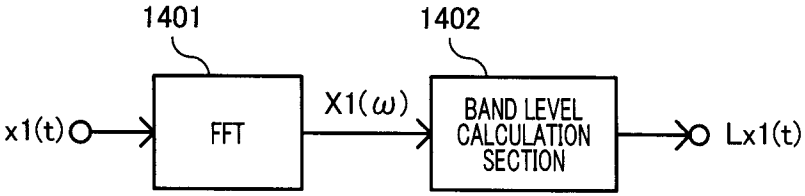
FIG. 18 illustrates other internal configuration of the first frequency analysis section illustrated in FIG. 8.

Further, although the present embodiment has explained a configuration where frequency analysis section 401 illustrated in FIG. 8 includes band-pass filter 501 and band level calculation section 502, the present invention is not limited to this. For example, as illustrated in FIG. 18, in the present embodiment, FFT (Fast Fourier Transform) section 1401, and band level calculation section 1402 may be provided. Hereinafter, this configuration will be explained briefly.

When an FFT length is assumed as N, FFT section 1401 accumulates N samples from first signal x1($t$), performs an FFT operation once to every N samples (frame length: N, overlapping rate: 0%), and calculates first complex signal X1(ω). Calculated complex signal X1(ω) is output to band level calculation section 1402.

Before performing the FFT operation, a windowing processing such as a Hanning window may be performed on a signal that accumulates N samples from first signal x1($t$). Further, the windowing processing and the FFT operation may be performed once every n/2 samples, that is, with frame length: N and overlapping rate: 50%.

Band level calculation section 1402 calculates first band level Lx1($t$) by using one or more first complex signal X1(ω) output from FFT section 1401. Equation 5 is an example of a calculation equation of Lx1($t$). [5]

$$Lx1(t) = 10 * \log_{10}\left\{(1-\tau)\cdot\frac{1}{\Delta\omega}\sum_{\omega=\omega 0}^{\omega 1} X1^2(\omega) + \tau\cdot 10^{Lx1(t-1)/10}\right\} \quad \text{(Equation 5)}$$

In equation 5, τ is a time constant, and takes a value in $0 \leq \tau < 1$. Further, suppose ω0 is a lower cut-off frequency point number, ω1 is an upper limit frequency number, Δω is a band width, and Δω=ω1−ω0+1. When supposing a sampling frequency is 48 kHz, the FFT length is 4096 and a band to calculate the level is, for example, near 100 Hz, the parameters ω is ω0=8 (93.75 Hz), ω1=9 (105.46875 Hz), and Δω=2.

(Embodiment 2)

Figure 19:
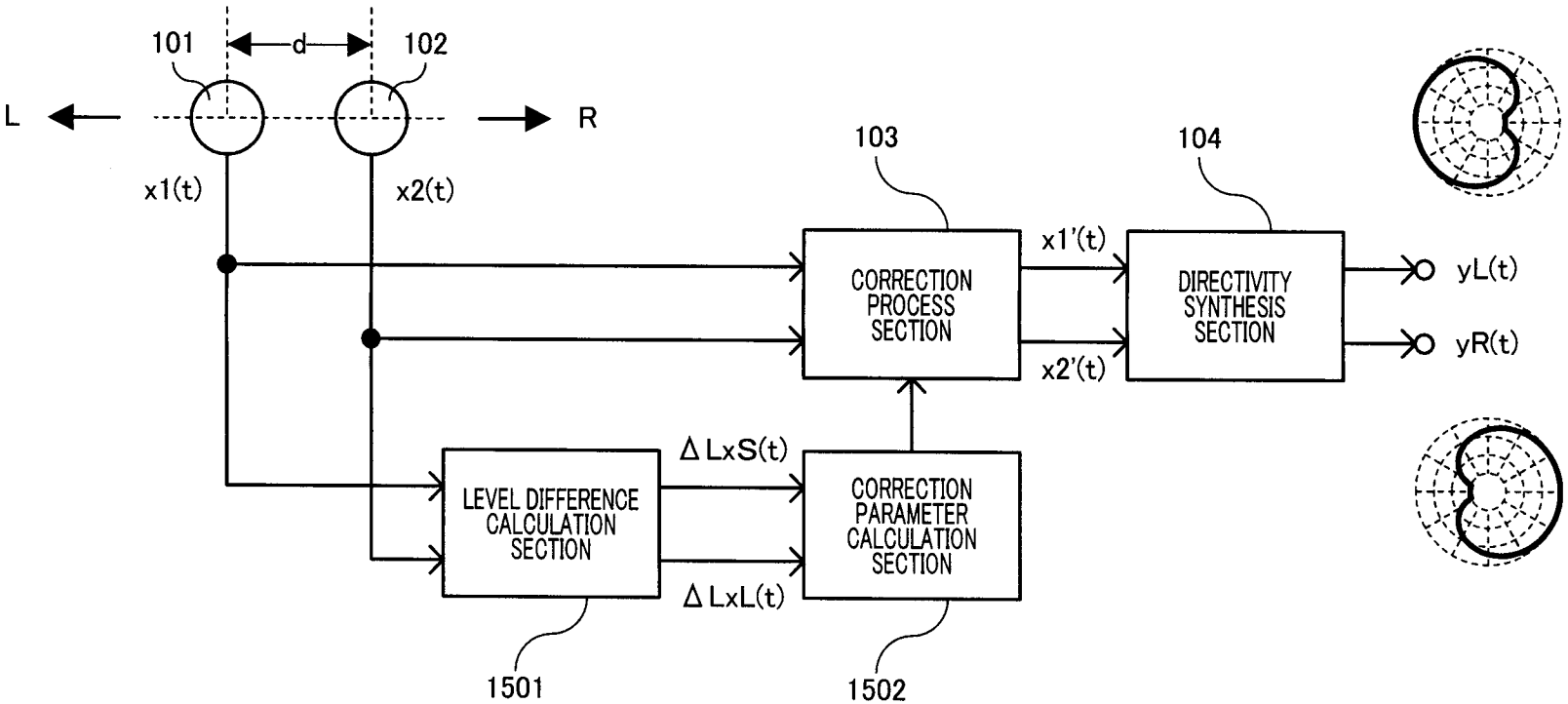
FIG. 19 illustrates a configuration of a directional microphone apparatus of embodiment 2 of the present invention.

FIG. 19 illustrates a configuration of a directional microphone apparatus of embodiment 2 of the present invention. FIG. 19 differs from FIG. 5 in that level difference calculation section 105 is changed to level difference calculation section 1501, and correction parameter calculation section 106 is changed to correction parameter calculation section 1502.

Figure 20:
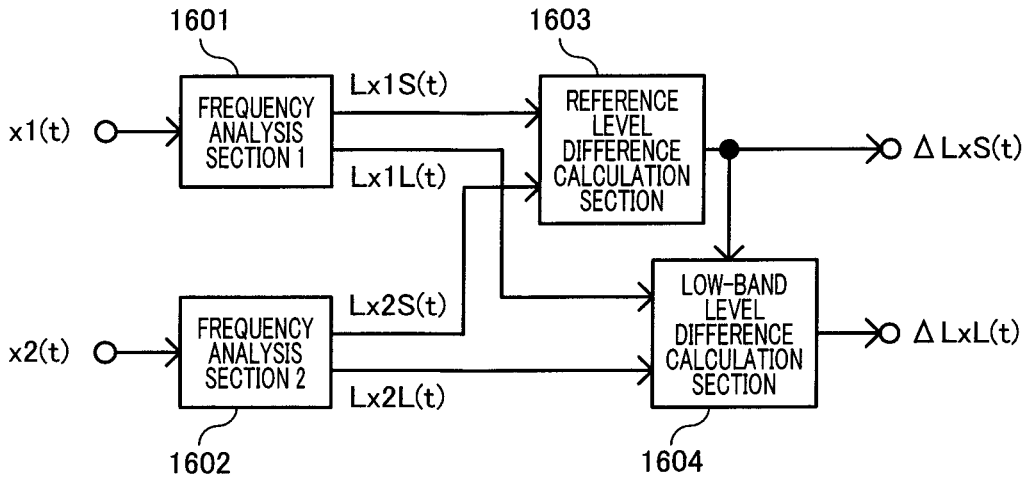
FIG. 20 illustrates an internal configuration of the level difference calculation section illustrated in FIG. 19.

As illustrated in FIG. 20, level difference calculation section 1501 includes first frequency analysis section 1601, second frequency analysis section 1602, reference level difference calculation section 1603, and low-band level difference calculation section 1604. Level difference calculation section 1501 inputs first signal x1($t$) obtained by first non-directional microphone unit 101 and second signal x2($t$) obtained by second non-directional microphone unit 102. Next, level difference calculation section 1501 calculates the level difference of first signal x1($t$) and second signal x2($t$) in at least two frequency bands. Specifically, the first level difference calculates the level difference in the frequency band of near 1 kHz that is used in measuring a rated sensitivity level of the non-directional microphone units. The second level difference calculates the level difference in an arbitrary frequency band lower than around 200 Hz where the level difference and the phase difference of the microphone units are likely to occur due to an influence of air leakage and the like from a gap of a swaged section at a back side of the microphone unit.

Figure 21:
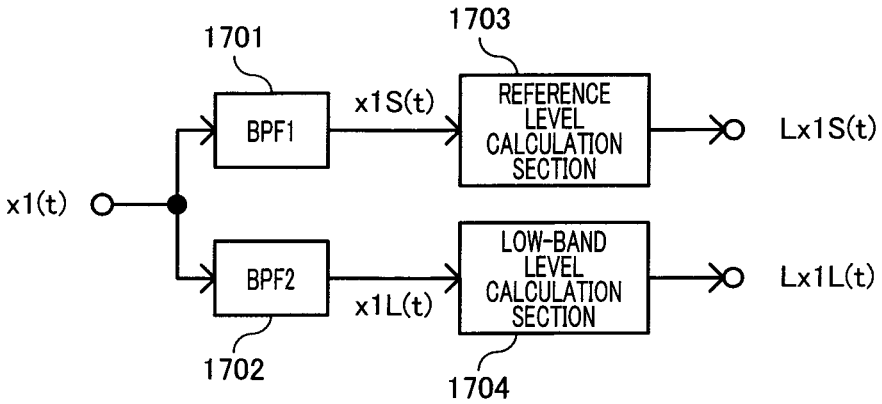
FIG. 21 illustrates the internal configuration of the first frequency analysis section illustrated in FIG. 20.

As illustrated in FIG. 21, first frequency analysis section 1601 includes first band-pass filter (BPF) 1701, second band-pass filter (BPF) 1702, and reference level calculation section 1703 and low-band level calculation section 1704. From first signal x1($t$) obtained by first non-directional microphone unit 101, first frequency analysis section 1601 calculates first reference level Lx1S(t) and first low-band level Lx1L(t). Calculated first reference level Lx1S(t) is output to reference level difference calculation section 1603. Further, first low-band level Lx1L(t) is output to low-band level difference calculation section 1604.

Figure 22:
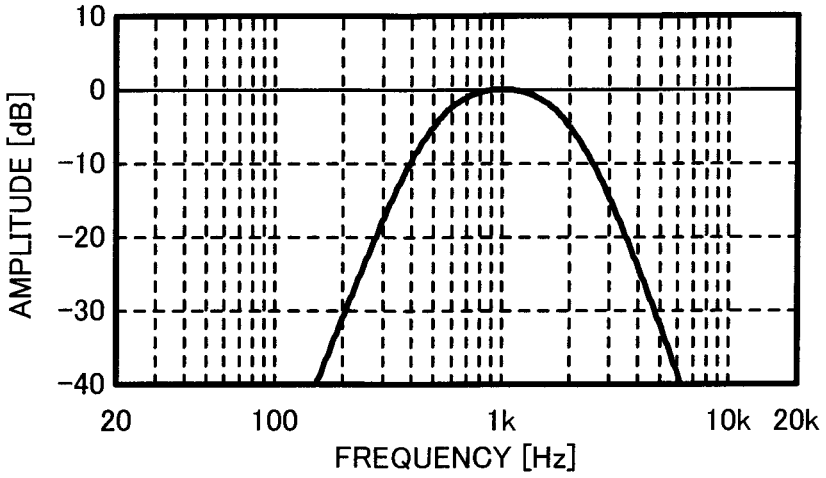
FIG. 22 illustrates amplitude frequency characteristic of a first band-pass filter configured of an IIR filter.

First band-pass filter 1701 is configured of an IIR filter or an FIR filter, and extracts a band signal near 1 kHz for a level adjustment between two non-directional microphone units. That is, first band-pass filter 1701 performs band-limiting of first signal x1($t$), and outputs first reference signal x1S(t) to reference level calculation section 1703. FIG. 22 illustrates the amplitude frequency characteristic of first band-pass filter 1701 configured of the IIR filter.

Second band-pass filter 1702 is configured of an IIR filter or an FIR filter, and extracts band signals for calculating the level differences that are necessary for the calculation of the correction parameters. That is, second band-pass filter 1702 performs band-limiting of first signal x1($t$), and outputs first low-band signal x1L(t) to low-band level calculation section 1704. Note that, the configuration and the operation of second band-pass filter 1702 is the same as band-pass filter 501 illustrated in FIG. 9.

Reference level calculation section 1703 calculates first reference level Lx1S(t) by using first reference signal x1S(t) output from first band-pass filter 1701, and outputs the result to reference level difference calculation section 1603. The calculation of first reference level Lx1S(t) is performed by equation 2, for example.

Low-band level calculation section 1704 calculates first low-band Lx1L(t) by using first low level signal x1L(t) output from second band-pass filter 1702, and outputs the result to low level difference calculation section 1604. The calculation of first low-band level Lx1L(t) is performed by equation 2, for example.

From second signal x2($t$) obtained by second non-directional microphone unit 102, second frequency analysis section 1602 calculates second reference level Lx2S(t) and second low-band level Lx2L(t). Second frequency analysis section 1602 differs from first frequency analysis section 1601 only in the input signal and has the same configuration and operation, so that the detailed explanation will be omitted.

Reference level difference calculation section 1603 calculates reference level difference ΔLxS(t) between first reference level Lx1S(t) output from first frequency analysis section 1601 and second reference level Lx2S(t) output from second frequency analysis section 1602. Reference level difference calculation section 1603 outputs calculated reference level difference ΔLxS(t) to correction parameter calculation section 1502 and low-band level difference calculation section 1604. Equation 6 is an example of a calculation equation of reference level difference ΔLxS(t) [dB].

$$\Delta LxS(t)=Lx1S(t)-Lx2S(t) \quad \text{(Equation 6)}$$

Low-band level difference calculation section 1604 calculates low level difference ΔLxL(t) between first low-band level Lx1L(t) output from first frequency analysis section 1601 and second low level Lx2L(t) output from second frequency analysis section 1602. In outputting the low-band level difference, low-band level difference calculation section 1604 performs correction of low-band level difference ΔLxL(t) by using reference level difference ΔLxS(t) output from reference level difference calculation section 1603. Equation 7 is an example of a calculation equation of low-band level difference ΔLxL(t).

$$\Delta LxL(t)=Lx1L(t)-Lx2L(t)-\Delta LxS(t) \quad \text{(Equation 7)}$$

Correction parameter calculation section 1502 calculates the correction parameters that simultaneously correct the level difference and the phase difference existing in first non-directional microphone unit 101 and second non-directional microphone unit 102, and outputs the result to correction process section 103.

Specifically, correction parameter calculation section 1502 calculates filter coefficients of first linear IIR filter 201 and second linear IIR filter 202 by a process similar to correction parameter calculation section 106, based on low-band level difference ΔLxL(t). The filter coefficients to calculate are b10($t$) (=1), b11($t$), a11($t$), b20($t$) (=1), b21($t$), and a21($t$).

Next, correction parameter calculation section 1502 multiplies a value where reference level difference ΔLxS(t) is transformed into a linear value, to each of b20($t$) and b21($t$) from among the coefficients of second linear IIR filter, and reassigns the results to b20($t$) and b21($t$). Equation 8 is an example of a calculation equation of b20($t$) and b21($t$).

$$b20(t)=b20(t)\times 10^{\frac{\Delta LxS(n)}{20}} \quad \text{(Equation 8)}$$

$$b21(t)=b21(t)\times 10^{\frac{\Delta LxS(n)}{20}}$$

Accordingly, embodiment 2 adjusts the level between two non-directional microphone units based on the signal near 1 kHz used for measuring the rated sensitivity level. By this means, in the present embodiment, it is possible to correct sensitivity deviation of about few dB that may generally exists in the non-directional microphone units. Further, in the present embodiment, it is possible to suppress the deterioration in the directivity even in a case of using microphone units with relatively large deviation in the rated sensitivity, or in a case where the sensitivity of the microphone units has changed due to aging and the like.

Figure 23:
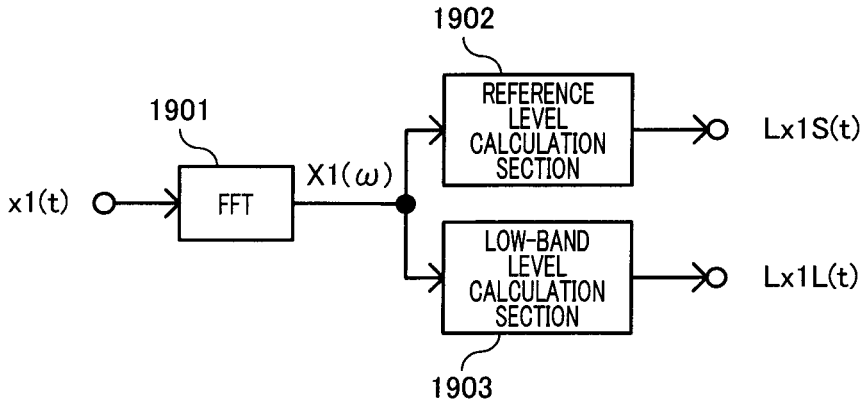
FIG. 23 illustrates other internal configuration of the first frequency analysis section illustrated in FIG. 20.

Here, the present embodiment has explained the configuration in which first frequency analysis section 1601 illustrated in FIG. 20 includes first band-pass filter 1701, second band-pass filter 1702, reference level calculation section 1703, and low-band level calculation section 1704. Note that, the present invention is not limited to this; for example, as illustrated in FIG. 23, it is equally possible to configure first frequency analysis section 1601 to include FFT section 1901, reference level calculation section 1902, and low-band level calculation section 1903. Hereinafter, this configuration will briefly be explained.

When an FFT length is assumed as N, FFT section 1901 accumulates N samples from first signal x1($t$), performs an FFT operation once to every N samples (frame length: N, overlapping rate: 0%), and calculates first complex signal X1(ω). Calculated complex signal X1(ω) is output to reference level calculation section 1902 and low-band level calculation section 1903. Note that, the configuration and operation of FFT section 1901 are the same as FFT section 1401.

Reference level calculation section 1902 calculates first reference level Lx1S(t) near 1 kHz by using one or more first complex signal X1(ω) output from FFT section 1901, for the level adjustment between two non-directional microphone units. The calculation of Lx1S(t) is performed by, for example, equation 5.

In equation 5, in a case of a sampling frequency of 48 kHz and the FFT length of 4096, the parameters ω are set at ω0=76 (890.625 Hz), ω1=88 (1031.25 Hz), Δω=13, and the like.

Low-band level calculation section 1903 calculates first low-band level Lx1L(t) by using one or more first complex signal X1(ω) output from FFT section 1901. The calculation of Lx1L(t) is performed by, for example, equation 5.

In equation 5, in a case of a sampling frequency of 48 kHz and the FFT length of 4096, the parameters ω are set at ω0=8 (93.75 Hz), ω1=9 (105.46875 Hz), Δω=2, and the like.

(Embodiment 3)

Figure 24:
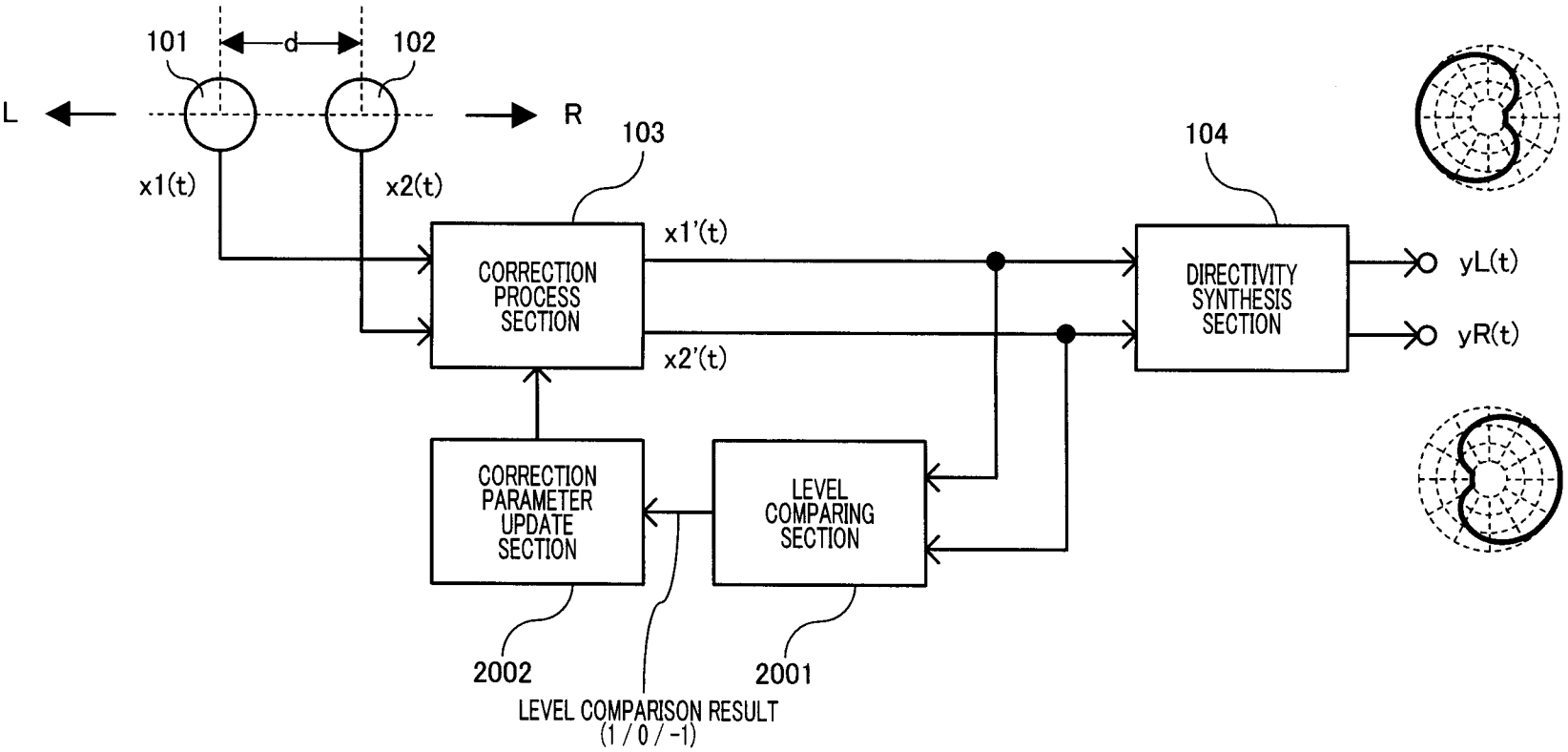
FIG. 24 illustrates a configuration of a directional microphone apparatus of embodiment 3 of the present invention.

FIG. 24 illustrates a configuration of a directional microphone apparatus of embodiment 3 of the present invention. FIG. 24 differs greatly from FIG. 5 in that the correction parameters of correction process section 103 are updated by using the output signals of correction process section 103, instead of the signals from the first and second non-directional microphone units. Specifically, the first modified point is that level difference calculation section 105 for calculating the level difference in the signals from the first and second non-directional microphone units is changed to level comparing section 2001 that compares levels of the output signals of correction process section 103. Further, the second modified point is that correction parameter calculation section 106 for calculating the correction parameters by using the level difference is changed to correction parameter update section 2002 that updates the correction parameters by using the comparison result of the levels.

Correction process section 103 inputs first signal x1($t$) from first non-directional microphone unit 101 and second signal x2($t$) from second non-directional microphone unit 102, respectively.

Correction process section 103 simultaneously corrects the level difference and the phase difference of two non-directional microphone units by using the correction parameters updated by correction parameter update section 2002 (described later). First filter output signal x1'($t$) and second filter output signal x2'($t$) in which the level difference and the phase difference have been corrected are output to directivity synthesis section 104 and level comparing section 2001, respectively. Since other configurations and operations are the same as described in embodiment 1, the detailed explanation will be omitted.

Figure 25:
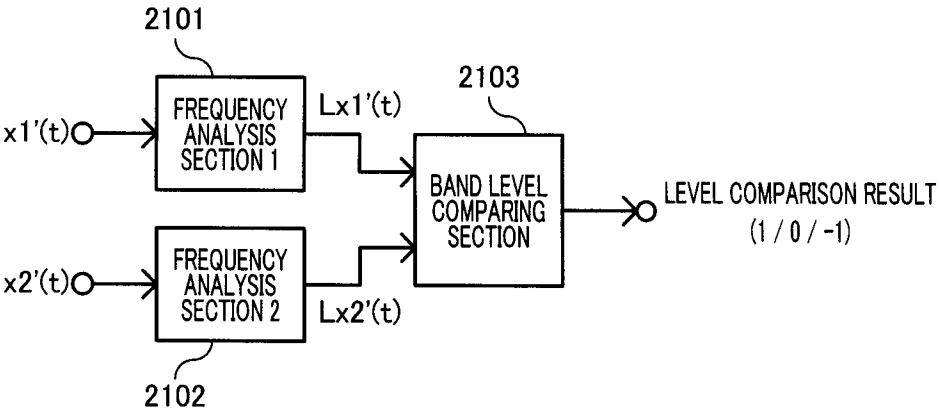
FIG. 25 illustrates an internal configuration of the level comparing section illustrated in FIG. 24.

As illustrated in FIG. 25, level comparing section 2001 includes first frequency analysis section 2101, second frequency analysis section 2102, and band level comparing section 2103. Level comparing section 2001 inputs first filter output signal x1'(*t*) that is an output from first linear IIR filter 201 and second filter output signal x2'(*t*) that is an output from second linear IIR filter 201. Level comparing section 2001 compares levels of first filter output signal x1'(*t*) and second filter output signal x2'(*t*), and outputs the comparison result to correction parameter update section 2002. The level comparison is performed for an arbitrary frequency band lower than around 200 Hz where the level difference and the phase difference between the microphone units are likely to occur due to an influence of air leakage and the like from a gap in a swaged section at a back side of the microphone unit.

First frequency analysis section 2101 calculates first band level Lx1'(*t*) from first filter output signal x1'(*t*). Further, second frequency analysis section 2102 calculates second band level Lx2'(*t*) from second filter output signal x2'(*t*). First and second frequency analysis sections 2101 and 2102 differ from first and second frequency analysis section 401 and 402 only in their input signal and have the same configuration, thus a detailed explanation thereof will be omitted.

Band level comparing section 2103 compares first band level Lx1'(*t*) output from first frequency analysis section 2101 and second band level Lx2'(*t*) output from second frequency analysis section 2102, and outputs the comparison result. For example, band level comparing section 2103 outputs "1" as the level comparison result in the case of Lx1'(*t*)<Lx2'(*t*) to correction parameter update section 2002. Further, band level comparing section 2103 outputs "−1" as the level comparison result in the case of Lx1'(*t*)>Lx2'(*t*) to correction parameter update section 2002. On the other hand, band level comparing section 2103 outputs "0" as the level comparison result in the case of Lx1'(*t*)≈Lx2'(*t*) to correction parameter update section 2002.

Correction parameter update section 2002 updates the coefficient of the linear IIR filter that simultaneously corrects the level difference and the phase difference in the low-band level of two non-directional microphone units. Specifically, correction parameter update section 2002 updates either b11(*t*) or b21(*t*) among the coefficients of first linear IIR filter 201 and the coefficients of second linear IIR filter 202 configuring correction process section 103. Note that, suppose the next coefficients are b10(*t*)=b20(*t*)=1. Further, next coefficients take values that are somewhat larger than −1, such as a11(*t*)=a21(*t*)=−0.998. Further, b11(*t*) and b21(*t*) will be through filters, so that b11(*t*)=a11(*t*) and b21(*t*)=a21(*t*) are set as the initial values.

Correction parameter update section 2002 performs the update of the filter coefficients based only on the comparison result from level comparing section 2001. The level difference and the phase difference in the low-band level between two non-directional microphone units caused by the presence/absence of the air leakage or by a degree of the air leakage have a one-to-one corresponding relationship. Consequently, correction parameter update section 2002 can update the coefficients such that the filter coefficients updated based only on the comparison result perform the simultaneous correction of the level difference and the phase difference. Notably, embodiment 3 is a configuration for correcting non-directional microphone units with the air leakage.

In the case where the comparison result is "1," correction parameter update section 2002 updates only coefficient b11(*t*) of first linear IIR filter 201 so as to correct first signal x1(*t*). Equation 9 is an example of an update equation of b11(*t*).

$$b11(t+1)=b11(t)+g \quad \text{(Equation 9)}$$

In equation 9, g is an update amount, and is set to a small positive value, for example, such as g=10^ (−23) and the like.

In the case where the comparison result is "−1," correction parameter update section 2002 updates only coefficient b21(*t*) of second linear IIR filter 202 so as to correct second signal x2(*t*). Equation 10 is an example of an update equation of b21(*t*).

$$b21(t+1)=b21(t)+g \quad \text{(Equation 10)}$$

In equation 10, g is an update amount and is the same value as equation 9.

In the case where the comparison result is "0," correction parameter update section 2002 has no level difference between two non-directional microphone units. In other words, correction parameter update section 2002 can determine the level and the phase of the two non-directional microphone units as almost coinciding, and does not perform the update of the coefficients.

Here, at least one of b11(*t*) and b21(*t*) invariably remains in the initial value.

Accordingly, the present embodiment updates the coefficients of the first linear IIR filter, based on the level difference in the low-band level between two non-directional microphone units. That is, the present embodiment performs the correction process based only on the size of the level between two non-directional microphone units, until the level difference in the low-band level between the two non-directional microphone units is substantially removed. By this means, the present embodiment can simultaneously correct the level difference and the phase difference in the low-band level between two non-directional microphone units, and can suppress the deterioration of the directivity with a small amount of calculation.

Note that, although the present embodiment has exemplified the case where the number of the non-directional microphone units is two, it is equally possible to utilize three or more non-directional microphone units. In such a case, the correction parameters can be updated in the similar method as above, based on the level comparison result with the compared respective non-directional microphone units with respect to the non-directional microphone unit having the highest band level.

(Embodiment 4)

Embodiments 1 to 3 have explained the cases of performing the correction on the non-directional microphone units having the air leakage. Embodiment 4 will explain a case of performing the correction on non-directional microphone units with no air leakage.

Figure 26:
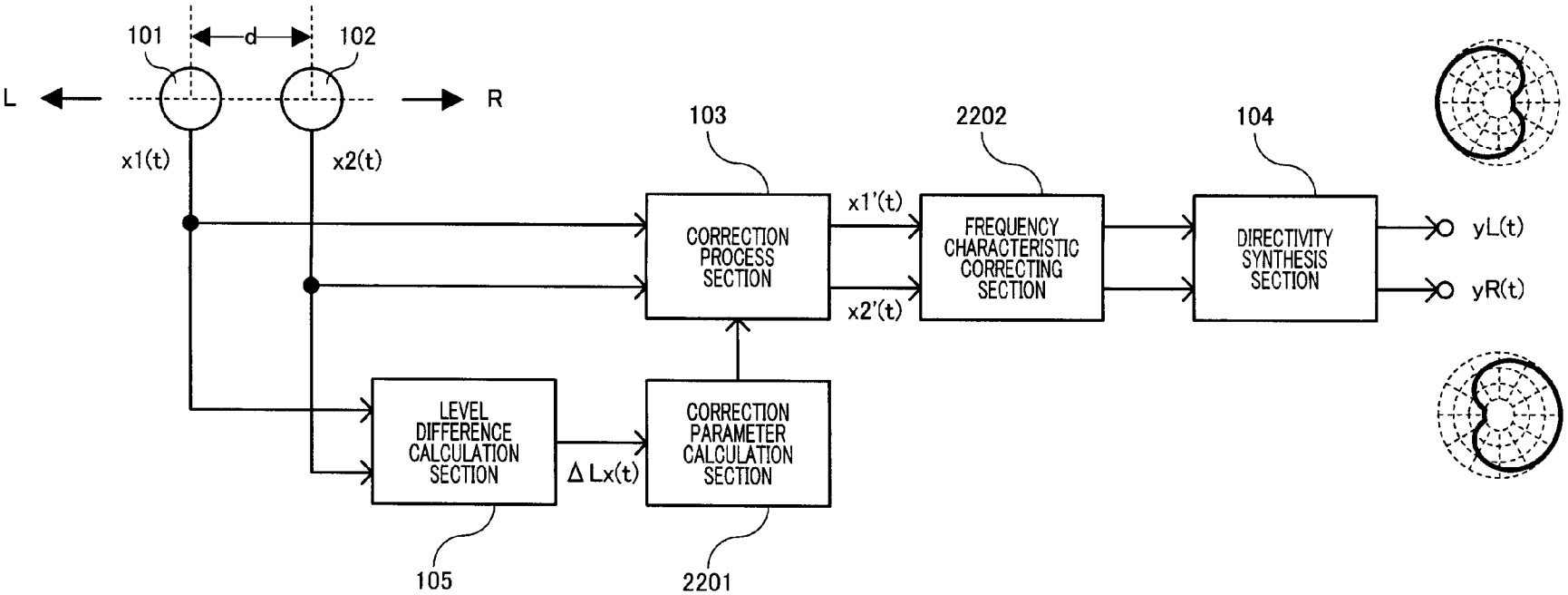
FIG. 26 illustrates a configuration of a directional microphone apparatus of embodiment 4 of the present invention.

FIG. 26 illustrates a configuration of a directional microphone apparatus according to embodiment 4 of the present invention. FIG. 26 differs from FIG. 5 in that correction parameter calculation section 106 is changed to correction parameter calculation section 2201, and frequency characteristic correcting section 2202 is added.

Correction parameter calculation section 2201 calculates correction parameters that simultaneously correct a level difference and a phase difference existing between first non-directional microphone unit 101 and second non-directional microphone unit 102, and outputs the result to correction process section 103. Note that, similar to correction parameter calculation section 106, correction parameter calculation section 2201 calculates the correction parameters, based on level difference ΔLx(*t*) output from level difference calculation section 105.

Correction parameter calculation section 2201 differs from correction parameter calculation section 106 in that correction parameter calculation section 2201 calculates filter coefficients of first linear IIR filter 201 and second linear IIR filter 202, and a calculation method of these filter coefficients. Note that, the filter coefficients to calculate are b10(*t*), b11(*t*), a11(*t*), b20(*t*), b21(*t*), and a21(*t*).

In a case where level difference ΔLx(t) is equal to or lower than threshold Lth1 (Lth1≤0) [dB], that is, ΔLx(t)≤Lth1, the coefficients of second linear IIR filter 202 are calculated so as to correct second signal x2(*t*). The filter coefficients to calculate are b20(*t*), b21(*t*), and a21(*t*). On the other hand, b10(*t*)=1, b11(*t*)=a11(*t*)=0 are assumed in order to cause first linear IIR filter 201 to be a through filter.

In a case where level difference ΔLx(t) is equal to or greater than threshold Lth2 (Lth2≥0) [dB], that is, ΔLx(t)≥Lth2, the coefficients of first linear IIR filter 201 are calculated so as to correct first signal x1(*t*). The filter coefficients to calculate are b10(*t*), b11(*t*), and a11(*t*). On the other hand, b20(*t*)=1, b21(*t*)=a21(*t*)=0 are assumed in order to cause second linear IIR filter 202 to be a through filter.

In the case where level difference ΔLx(t) is larger than threshold Lth1 and smaller than threshold Lth2, that is, Lth1<ΔLx<Lth2, there is no level difference between two non-directional microphone units. In other words, it is possible to determine the level and the phase of the two non-directional microphone units as substantially coinciding. Thus, b10(*t*)=1, b11(*t*)=a11(*t*)=0, b20(*t*)=1, and b21(*t*)=a21(*t*)=0 are assumed in order to cause first linear IIR filter 201 and second linear IIR filter 202 to be through filters.

Next, in regard to the filter coefficient calculation method in correction parameter calculation section 2201, an explanation will be given by exemplifying a case of ΔLx(t) z Lth2, that is, a case of calculating coefficients b10(*t*), b11(*t*), and a11(*t*) of first linear IIR filter 201.

Figure 27:
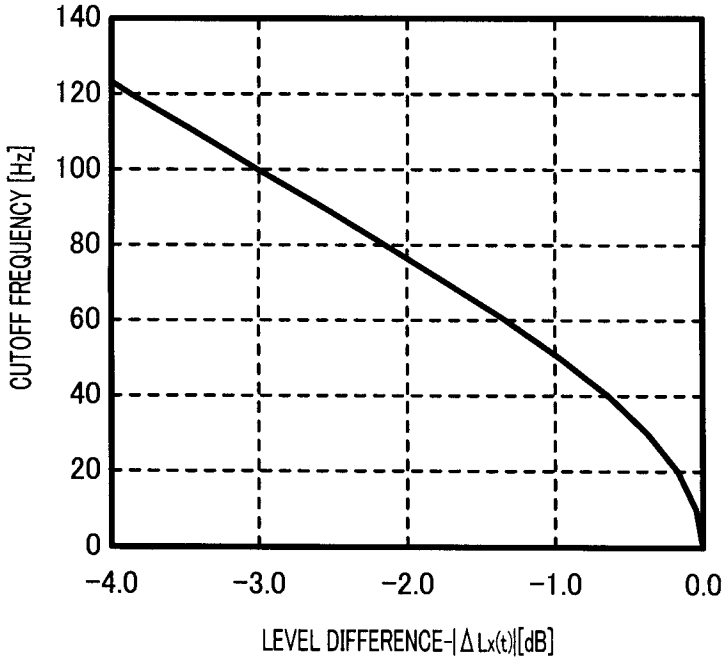
FIG. 27 illustrates a relationship of level difference $-|\Delta Lx(t)|$ near 100 Hz and cutoff frequency.

First, correction parameter calculation section 2201 estimates a cutoff frequency of a linear high-pass characteristic, based on level difference ΔLx(t) near 100 Hz. FIG. 27 illustrates a relationship of level difference −|ΔLx(t)| near 100 Hz and the cutoff frequency.

Next, correction parameter calculation section 2201 calculates a coefficient of a linear high-pass filter, by using a general calculation method for digital filters based on the estimated cutoff frequency. Specifically, correction parameter calculation section 2201 calculates coefficients b10(*t*), b11(*t*), and a11(*t*) of the linear high-pass filter having, for example, a Butterworth characteristic.

Correction parameter calculation section 2201 calculates the correction parameters for adjusting a level and a phase of an non-directional microphone unit with no air leakage to the level and the phase of the non-directional microphone unit with the air leakage. Consequently, the amplitude frequency characteristic after the correction comes to be a characteristic with lowered level in a low band relative to the inherent non-directional microphone unit not having the air leakage.

Frequency characteristic correcting section 2202 is configured of an IIR filter or an FIR filter, and corrects the amplitude frequency characteristic with lowered level in a low band of first filter output signal x1'(*t*) and second filter output signal x2'(*t*) output from correction process section 103.

Note that, in the present embodiment, it is equally possible to include the processing of frequency characteristic correcting section 2202 in EQ 306 that is a component of directivity synthesis section 104. Further, it is equally possible to use frequency characteristic correcting section 2202 for the purpose of realizing an arbitrary frequency characteristic if necessary.

Accordingly, embodiment 4 is configured to calculate the coefficients of the linear IIR filter that simultaneously corrects the level difference and the phase difference by using the general filter coefficient calculation method. By this means, embodiment 4, it is possible to perform correction even in a lower band, and suppress deterioration of directivity even in a broader band.

Note that, although the present embodiment has exemplified the case where the number of the non-directional microphone units is two, it is equally possible to utilize three or more non-directional microphone units. In such a case, the correction parameters can be calculated in the similar method as above, based on the level differences between the respective non-directional microphone units that are calculated on the basis of the non-directional microphone unit having the highest band level.

Further, although the above each embodiment has been explained by a dB value, the present invention is not limited to this, and it is equally possible to use a linear value equivalent to the dB values.

Figure 28A:
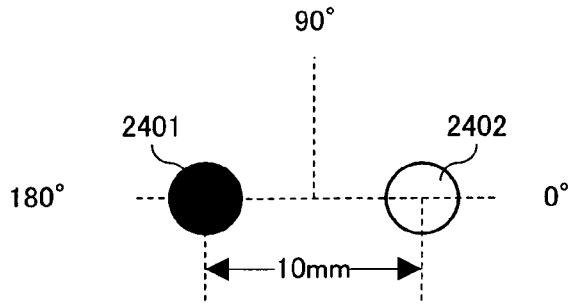
FIG. 28 illustrates a result of calculator simulation using recorded data of actual non-directional microphone units by the directional microphone apparatus of the present invention.
Figure 28B:
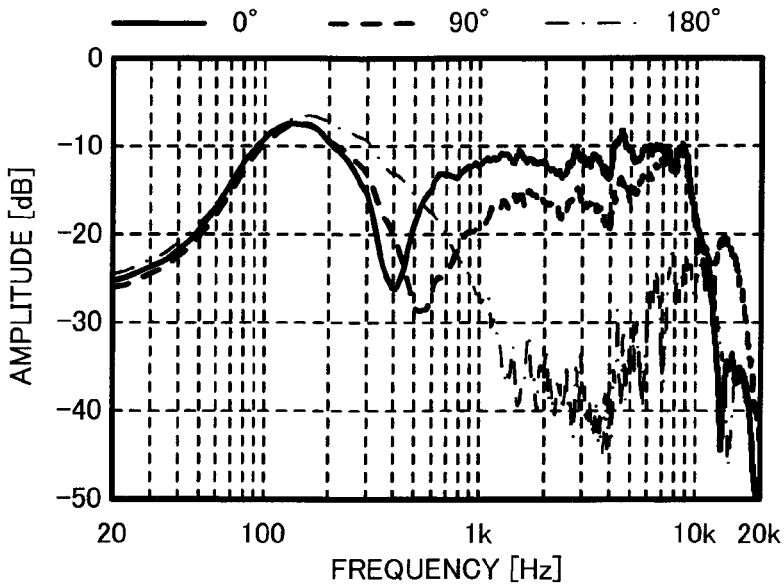
Figure 28C:
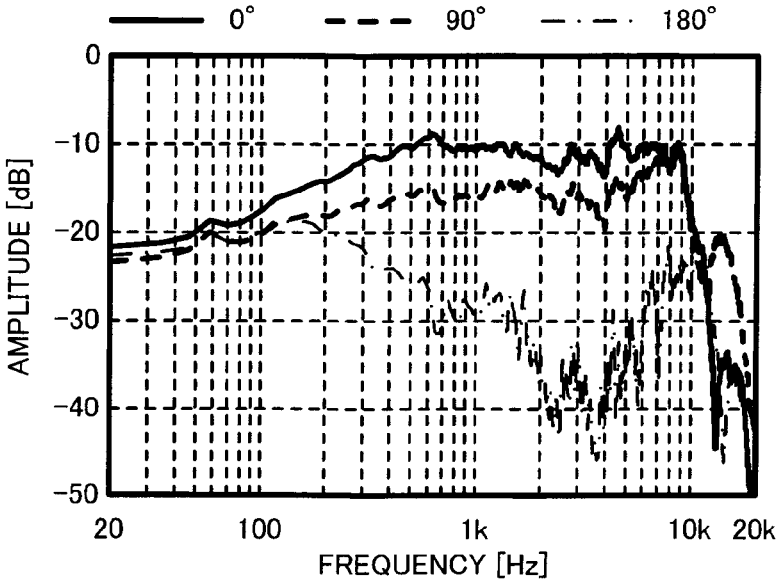

FIG. 28 illustrates an example of calculator simulation result using recorded data of actual non-directional microphone units by the directional microphone apparatus of the present invention. FIG. 28A illustrates a relationship of an arrangement of the two non-directional microphone units and a sound source direction during recording. In FIG. 28A, an interval between the two non-directional microphone units is 10 mm. Further, in FIG. 28A, the non-directional microphone unit with the air leakage is left side 2401 (black circle), and the non-directional microphone unit with no air leakage is right side 2402 (white circle). FIG. 28B indicates the amplitude frequency characteristic for different directions to which directivity synthesis has been performed by using signals from the two non-directional microphone units, that is, recorded data themselves. Further, FIG. 28C indicates the amplitude frequency characteristic for different directions using the directivity synthesis by the directional microphone apparatus of the present invention. In each of the drawings, a solid line is 0° direction, a dotted line is 90° direction, and a dash dotted line is 180° direction. As illustrated in FIG. 28, in the present embodiment, it can be confirmed that the directivity in the low band is improved by the employment of the directional microphone apparatus of the present invention.

Other Embodiments

Although the present invention has been explained based on the above embodiments, obviously the present invention is not limited to the above embodiments. The present invention includes cases as follows.

(1) The respective process sections (level difference calculation section, correction parameter calculation section, correction process section, directivity synthesis section and the like) other than the microphones are specifically implemented by a computer system configured of a microprocessor, a ROM (Read Only Memory), a RAM (Random Access Memory) and the like. The RAM stores a computer program. The respective apparatuses fulfill their functions by the microprocessor operating in accordance with the computer program. Here, the computer program is configured by combining a plurality of instruction codes indicating instructions to a computer by cooperating with hardware in order to fulfill a specific function.

(2) A part or all of the components configuring the above respective apparatuses may be configured of one system LSI (Large Scale Integration). The system LSI is an ultra-multifunction LSI that is manufactured by integrating a plurality of constituent sections on one chip, and specifically is a computer system configured by including the microprocessor, the ROM, the RAM and the like. The RAM stores a computer program. The system LSI fulfills its function by the microprocessor operating in accordance with the computer program.

(3) A part or all of the components configuring the above respective apparatuses may be configured of an IC (Integrated Circuit) card or a single module that can be detachably attached to the respective apparatuses. The IC card or the module is a computer system configured of a microprocessor, a ROM, a RAM and the like. The IC card or the module may include the above ultra-multi function LSI. The IC card or the module fulfills the function by the microprocessor operating in accordance with the computer program. The IC card or the module may have a tamper resistance.

(4) The present invention may be the method described above. Further, these methods may be computer programs realized by a computer, or may be digital signals configured of the computer programs.

Further, the present invention may be recorded on a recording medium capable of reading the computer programs or the digital signals by the computer, such as flexible hard disc, hard disc, CD-ROM (Compact Disc Read Only Memory), MO (Magneto-Optical disc), DVD (Digital Versatile Disc), DVD-ROM, DVD-RAM, BD (Blue-ray Disc), semiconductor memory and the like. Further, the present invention may be the digital signals recorded on those recording medium. Further, the present invention may transmit the computer programs or the digital signals through a network, a data broadcasting and the like represented by an electric communication line, a wireless or wired communication line, and the Internet. Further, the present invention may be a computer system including a microprocessor and a memory, the memory store the computer programs, and the microprocessor may operate in accordance with the computer programs. Further, the present invention may be embodied by another independent computer system by recording the programs or the digital signals on the recording medium and transporting the medium, or by transferring the programs or the digital signals through the network.

(5) Each of the above embodiments may be combined with one another.

The disclosure of Japanese Patent Application No. 2010-152030, filed on Jul. 2, 2010, including the specification, drawings and abstract, is incorporated herein by reference in its entirety.

INDUSTRIAL APPLICABILITY

The directional microphone apparatus and directivity control method according to the present invention improves the attenuation in the low band due to the air leakage and the like, corrects the level difference and the phase difference generated in the low band in the plurality of non-directional microphone units, improves the directivity, and reduces the size. By this means, the directional microphone apparatus and directivity control method according to the present invention is useful in a video camera, a hearing aid, a recorder (IC recorder) and the like which utilize a plurality of non-directional microphones apparatuses.

REFERENCE SIGNS LIST

101 First non-directional microphone unit
102 Second non-directional microphone unit
103 Correction process section
104 Directivity synthesis section
105, 1501 Level difference calculation section
106, 1502, 2201 Correction parameter calculation section
201 First linear IIR filter
202 Second linear IIR filter
301 Left side directivity synthesis section
302 Right side directivity synthesis section
303 First delayer
304 Second delayer
305, 903 Subtractor
306 EQ
401, 1601, 2101 First frequency analysis section
402, 1602, 2102 Second frequency analysis section
403 Band level difference calculation section
501 Band-pass filter
502 Band level calculation section
701 Sound hole
702 Vibrating membrane
703 Thin air layer
704 Back electrode
705 Insulating member
706 Back section air chamber
707 Leak hole
708 Swaged section
801 Air duct
901 First signal line
902 Second signal line
1401, 1901 FFT section
1402 Band level calculation section
1603 Reference level difference calculation section
1604 Low-band level difference calculation section
1701 First band-pass filter
1702 Second band-pass filter
1703, 1902 Reference level calculation section
1704, 1903 Low-band level calculation section
2001 Level comparing section
2002 Correction parameter update section
2103 Band level comparing section
2202 Frequency characteristic correcting section The invention clamied is:

1. A directional microphone apparatus comprising:

a plurality of non-directional microphone units;

a correction processor configured to correct a plurality of signals obtained by the plurality of non-directional microphone units by using a correction parameter;

a directivity synthesizer configured to perform directivity synthesis by using the plurality of signals corrected;

a level difference calculator configured to calculate a level difference between the plurality of non-directional microphone units; and a correction parameter calculator configured to calculate the correction parameter based on the level difference, the correction parameter for correcting simultaneously the level difference and a phase difference in the plurality of non-directional microphone units in the correction processor, wherein the correction parameter calculator determines a first non-directional microphone unit having a lower level in a low band among the plurality of non-directional microphone units based on the level difference calculated by the level difference calculator, and calculates a filter coefficient having an inverse characteristic of a digital filter, the digital filter corresponding to the first non-directional microphone unit, and the correction processor corrects a first signal obtained by the first non-directional microphone unit by multiplying the first signal by the filter coefficient calculated by the correction parameter calculator.

2. A directional microphone apparatus comprising:

a plurality of non-directional microphone units;

a correction processor configured to correct a plurality of signals obtained by the plurality of non-directional microphone units by using a correction parameter;

a directivity synthesizer configured to perform directivity synthesis by using the plurality of signals corrected;

a level comparator configured to compare a level of a signal that is a reference with levels of other signals among the plurality of signals corrected; and a correction parameter update section configured to update the correction parameter based on the level comparison result, the correction parameter for correcting simultaneously a level difference and a phase difference in the plurality of non-directional microphone units in the correction processor, wherein the correction parameter update section determines a first non-directional microphone unit having a lower level in a low band among the plurality of non-directional microphone units based on a level difference compared by the level comparator, and performs update by calculating a filter coefficient having an inverse characteristic of a digital filter, the digital filter corresponding to the first non-directional microphone unit, and the correction processor corrects a first signal obtained by the first non-directional microphone unit by multiplying the first signal by the filter coefficient updated by the correction parameter update section.

3. The directional microphone apparatus according to claim 1 or claim 2, wherein the correction processor is a linear IIR filter.

4. The directional microphone apparatus according to claim 3, wherein the correction parameter is a filter coefficient of the linear IIR filter.

5. The directional microphone apparatus according to claim 4, wherein the correction parameter calculator calculates the filter coefficient of the linear IIR filter having an inverse characteristic of a digital filter corresponding to an non-directional microphone unit having a linear high pass characteristic.

6. The directional microphone apparatus according to claim 4, wherein the correction parameter calculator updates the filter coefficients of the linear IIR filter so as to have an inverse characteristic of a digital filter corresponding to an non-directional microphone unit having a linear high pass characteristic.

7. The directional microphone apparatus according to claim 1, wherein the level difference calculator calculates level differences of a signal obtained by an non-directional microphone that is a reference and signals obtained by other non-directional microphone units for each of a plurality of frequency bands.

8. The directional microphone apparatus according to claim 7, wherein the correction parameter calculator calculates the correction parameters, based on two or more level differences among the level differences calculated for each of the plurality of frequency bands.

9. A directivity control method comprising:

a correction processing step of correcting a plurality of signals obtained by a plurality of non-directional microphone units by using a correction parameter;

a directivity synthesis step of performing directivity synthesis by using the plurality of signals corrected;

a level difference calculating step of calculating a level difference between the plurality of non-directional microphone units; and a correction parameter calculating step of calculating the correction parameters based on the level difference, the correction parameters for correcting simultaneously the level difference and a phase difference in the plurality of non-directional microphone units in the correction processing step, wherein in the correction parameter calculation step, a first non-directional microphone unit having a lower level in a low band among the plurality of non-directional microphone units is determined based on the level difference calculated in the level difference calculation step, and calculates a filter coefficient having an inverse characteristic of a digital filter, the digital filter corresponding to the first non-directional microphone unit, and in the correction process step, a first signal obtained by the first non-directional microphone unit is corrected by multiplying the first signal by the filter coefficient calculated in the correction parameter calculation step.

10. A directivity control method comprising:

a correction processing step of correcting a plurality of signals obtained by a plurality of non-directional microphone units by using a correction parameter;

a directivity synthesis step of performing directivity synthesis by using the plurality of signals corrected;

a level comparing step of comparing a level of a signal that is a reference with levels of other signals among the plurality of signals corrected; and a correction parameter updating step of updating the correction parameters based on the level comparison result, the correction parameters for correcting simultaneously a level difference and a phase difference in the plurality of non-directional microphone units in the correction processing step, wherein in the correction parameter update step, a first non-directional microphone unit having a lower level in a low band among the plurality of non-directional microphone units is determined based on a level difference compared in the level comparing step, and performs update by calculating a filter coefficient having an inverse characteristic of a digital filter, the digital filter corresponding to the first non-directional microphone unit, and in the correction process step, a first signal obtained by the first non-directional microphone unit is corrected by multiplying the first signal by the filter coefficient updated in the correction parameter update step.

* * * * *